US006877939B2

(12) United States Patent
Tomkins et al.

(10) Patent No.: US 6,877,939 B2
(45) Date of Patent: Apr. 12, 2005

(54) TRANSPORT LINKING FRAMES

(76) Inventors: Philip Tomkins, 58 Fronks Road, Dovercourt, Essex CO12 3RW (GB); Nicholas Michael Kavanagh, Highview, 105 Scarborough Drive, Minster, Sheppey, Kent ME12 2LX (GB); Francis David Patten, 21 Recreation Avenue, Corringham, Essex, SS17 9BZ (GB)

( * ) Notice: Subject to any disclaimer, the term of this patent is extended or adjusted under 35 U.S.C. 154(b) by 64 days.

(21) Appl. No.: 10/362,434

(22) PCT Filed: Aug. 17, 2001

(86) PCT No.: PCT/GB01/03689

§ 371 (c)(1),
(2), (4) Date: Feb. 20, 2003

(87) PCT Pub. No.: WO02/16230

PCT Pub. Date: Feb. 28, 2002

(65) Prior Publication Data

US 2004/0028495 A1 Feb. 12, 2004

(30) Foreign Application Priority Data

Aug. 23, 2000 (GB) ..... 0024014

(51) Int. Cl.[7] ..... B60P 7/13

(52) U.S. Cl. ..... 410/46; 410/34; 410/35; 410/77; 410/82

(58) Field of Search ..... 410/34, 35, 46, 410/68, 77, 78, 82; 24/287; 206/503, 509; 220/1.5, 4.26, 43.27

(56) References Cited

U.S. PATENT DOCUMENTS

| | | | | | |
|---|---|---|---|---|---|
| 3,691,595 | A | * | 9/1972 | Backteman et al. | 24/287 |
| 3,776,169 | A | * | 12/1973 | Strecker | 410/77 |
| 4,221,515 | A | * | 9/1980 | Brown et al. | 410/32 |
| 4,341,495 | A | * | 7/1982 | Del'Acqua | 410/78 |
| 4,591,307 | A | * | 5/1986 | Clive-Smith | 410/83 |
| 4,648,764 | A | * | 3/1987 | Pavlick | 410/77 |
| 4,768,906 | A | * | 9/1988 | Gerhard | 410/84 |
| 4,950,114 | A | * | 8/1990 | Borchardt | 410/82 |
| 6,027,291 | A | * | 2/2000 | Sain et al. | 410/35 |
| 6,112,929 | A | * | 9/2000 | Ota | 220/8 |
| 6,210,088 | B1 | * | 4/2001 | Crosby | 410/35 |
| 6,422,795 | B2 | * | 7/2002 | Holt et al. | 410/115 |
| 6,572,325 | B2 | * | 6/2003 | Kelly | 414/792.7 |

* cited by examiner

*Primary Examiner*—D. Glenn Dayoan
*Assistant Examiner*—Paul Chenevert
(74) *Attorney, Agent, or Firm*—Barnes & Thornburg LLP

(57) ABSTRACT

Frames and attachments thereto and methods of use thereof for the support and/or releasable securing of cargo and/or cargo containers upon and/or to cargo containers and/or cargo container transports and/or lifting devices. Linking frame (10) may be used upon and/or beneath containers that possess insufficient mutually corresponding mounting-points to otherwise enable them to be vertically stacked and secured together. Parallel longitudinal beams (11) are joined by shorter lateral beams (12). Attached directly or indirectly, protruding outward the outer side surfaces of said framework, are connectors (13) able to correspond upwardly and/or downwardly with various mounting-point layouts as provided upon the surfaces of cargo transport equipment.

12 Claims, 15 Drawing Sheets

TRANSPORT LINKING FRAMES

The present invention relates to frames and attachments thereto and to methods of using said frames and attachments for the support and/or releasable securing of cargo and/or cargo containers upon and/or to cargo containers and/or cargo container transports and/or lifting devices.

The terms 'cargo containers' and 'containers' as used herein relate to cuboid metal containers as commonly used for the containment of generally dry or frozen cargoes and to cylindrical tanks strengthened by frames as commonly used for the containment of cargoes that may comprise for example liquids, gases, granules or powders, all said types of cargo container having the ability to be mounted upon each other and upon cargo container transports whenever provided with mutually compatible mounting-point layouts.

Other types of containers exist that have soft or non-existent upper bodywork but that may still derive benefits from connection with linking frames of the present invention in respect of their upward support.

The term 'cargo container transports' as used herein relates to means of upwardly supporting and facilitating the transportation of containers across land or water and may include for example lorries and/or trailers and/or railway flat-cars and/or marine vessels and/or any other upwardly supporting mobile platforms to which cargo containers may be releasably secured by mutually compatible mounting-points.

The term 'lifting device' as used herein relates to any machine or mechanism that is capable of connecting with and lifting cargo containers.

Cargo containers for international use are generally manufactured according to specifications issued by the International Standards Organization, strengthened mounting-points being provided at their outermost corners in one of several horizontal rectangular layouts, depending on their overall lengths. These layouts accord with standard horizontal distances recommended by ISO to ensure worldwide compatibility in their stacking with other containers or for connecting to cargo container transports and/or lifting devices.

The mounting-points of cargo containers incorporate female locking apertures that can be indirectly releasably secured to vertically corresponding female locking apertures of mounting-points on other cargo containers by the use of portable male twist-lock mechanisms as known in the art and can also be directly releasably secured to male mounting-points as generally provided upon cargo container transports and lifting devices.

After loading, for example, a first cargo container onto a cargo container transport, or onto a second cargo container in order to save space and/or transport energy, it is common safe practice that said first container must be releasably secured between four mounting-points at its lower surface and four corresponding mounting-points at the upper surface of said cargo container transport or said second container.

In order to releasably secure two cargo containers together vertically by the use of portable twist-locks an operative carries said twist-locks to the top of the receiving container and inserts the downward-protruding locking-cone of each twist-lock into each upward-acting mounting-point locking aperture, also turning the control-lever on each twist-lock so that said downward locking-cone grips the locking aperture, whilst leaving the twist-lock's upward-protruding locking-cone in what may be termed the 'receiving' position. The second container is then craned onto the receiving container so that the downward-acting locking apertures of the mounting-points at its lower surface cover the upward-protruding locking-cones of the portable twist-locks mated to the receiving container. The crane then detaches and the operative goes back up to the protruding control-levers on each twist-lock and turns both the upward-acting and downward-acting locking-cones to their 'fully locked' positions.

Another method of twist-locking two cargo containers together vertically is that whilst what is intended to be the upper container is held above ground level by a crane an operative inserts a portable twist-lock into each downward-acting mounting-point at the bottom corners of said container and locks their upward-protruding locking-cones by turning their control-levers, leaving each twist-lock's downward-protruding locking-cone in the 'receiving' position. Said container is then craned onto the receiving container so that the downward-acting locking-cones of said mated twist-locks enter the upward-acting mounting-point apertures of the receiving container. The crane then detaches and the operative climbs or is lifted back up to each control-lever in order to turn both the upward-acting and downward-acting locking-cones to their 'fully locked' positions.

Owing to the weight of said twist-locks and the physical positions that the operative must adopt, in all weathers, during these various stages, both of the above methods of securing containers together may be considered dangerous. They may also be considered inefficient in terms of the time taken and labor employed.

ISO standard cargo containers are provided with mounting-points exactly at their outermost top and bottom corners; therefore portable twist-locks are used throughout the world that have short control-levers that, nevertheless, are able to protrude longitudinally from between the mated front and rear corners of stacked containers. However, many containers also now exist that have been elongated beyond the ISO recommended standard lengths. Despite such containers' additional lengths the worldwide transport infrastructure still depends upon their mounting-point layout remaining to ISO conformity.

The resulting effect is that the mounting-points on some such elongated containers are not at the outermost corners of the containers but are instead some distance inboard of them or inboard of one end only and therefore the control-levers of twist-locks used to secure such containers no longer protrude from the ends of the containers and have to be accessed from the side.

Sideways access to the longitudinal control-levers of standard twist-locks when used between such vertically stacked elongated containers is awkward because of the restricted space in which to see, reach and operate them, combined with the fact that the operative is often at the top of a ladder.

Surrounding the center of each twist-lock is a ring of metal that may be referred to as a resting-plate, which prevents the twist-lock from recessing too far into a receiving locking aperture and also provides a correct separation, that being approximately 2.5 cm, for locking compatibility between it and a corresponding mounting-point. Although mounting-points often protrude slightly from the top and bottom surfaces of cargo containers the total space between the upper and lower surfaces of stacked elongated containers that is available for the operation of twist-lock control-levers at mounting-point locations in-board of the outermost corners remains dangerously little for a hand inserted between the containers. There is also a danger that, because it is difficult to see the position of the control-levers in the confined space available, they might be incorrectly confirmed as fully locked or unlocked prior to or after a lifting operation.

Cargo containers manufactured to ISO conformity are generally 20 ft, 30 ft or 40 ft long and have a mounting-point at each outermost corner. Therefore a container of one such ISO standard length cannot be vertically stacked and releasably secured to one of another ISO standard length because only one pair of mounting-points on each container will correspond.

This inability to stack even standard ISO containers unless they possess fully co-operating mounting-points results in a waste of space, energy and time owing to the separate stacking and transporting of the different types. This wastage would be reduced if the shorter containers could be fully secured atop containers of other lengths, for example a 20 ft onto a 30 ft or 40 ft, a 30 ft or two 20 fts onto a 40 ft, or a 30 ft onto two 20 fts.

The possible installation of additional mounting-points upon, for example, 40 ft containers at the 20 ft or 30 ft positions has not become internationally standard practice because their inclusion would necessitate reinforcement around and beneath each mounting-point that would impede a container's internal loading capacity and also add to it's tare weight, thereby reducing its carrying capacity under road use regulations in many countries.

Although it is not possible to safely load, for example, two 20 ft containers on top of a 40 ft owing to lack of reinforced mounting-points located centrally upon the 40 ft it is permitted, subject only to center of gravity considerations, to load a 40 ft onto two 20 fts and releasably secure the 40 ft's lower mounting-points to the two longitudinally outermost pairs of mounting-points atop the pair of 20 fts. However, containers manufactured in accordance with ISO conformity may vary in their heights, therefore if the 20 fts in this case had different heights the combination as described could not take place because one longitudinally outermost pair of mounting-points at the lower surface of the 40 ft could not connect with those on one of the 20 fts beneath it. Such considerations routinely disrupt planning or unnecessarily divert and distract labor, there frequently being no solution other than to transport the containers separately.

Although in general containers employed upon international journeys do not vary greatly in width, because of the need to conform with ISO compatibility guidelines, there are instances where such internationally-travelling cargo containers meet with containers that are restricted to purely domestic journeys and those domestic containers have been built to a greater length and width, as permitted under local regulations. This situation arises for example in the USA, where domestic containers are generally 102 inches wide, with a horizontal width between mounting-point centers of 96 inches, as compared to international containers that are 96 inches wide, with an ISO standard horizontal width between mounting-point centers of 89 inches. In such circumstances it is an economic and environmental disadvantage that standard international containers and standard domestic containers cannot be vertically secured together in lateral or longitudinal symmetrical alignment, nor therefore be lifted and/or transported together as a combined unit.

Cargo container transports having mounting-points able to connect only to containers of ISO standard width or only to wider domestic containers cannot safely carry the other type of containers without adaptation. Similarly a cargo container transport may not have sufficient original mounting-points fitted to enable it to carry more than one or two lengths of cargo container. Retro-fitting of possible extensions or additional mounting-points to existing cargo container transports may not be possible owing to the resultant weakening of their designed structure and even when inclusion of such versatility is occasionally included during manufacture this can often be seen as not carrying-through to the next sector in a logistics chain, such as at the interchange between road and rail carriage, opportunities for extended trade therefore being lost.

The movement of cargo containers over short distances within a port or storage area is generally performed by a mobile lifter, a straddle carrier or a fork-lift having a downward-acting lifting adapter or arms. It is not practical to transport cargo containers by these methods over longer distances owing to the driver's restricted vision and the ponderous overall dimensions of such combinations. For onward transportation containers are therefore placed longitudinally upon cargo container transports and are releasably secured to them by their mutually corresponding mounting-points.

A further method of transporting a container within ports or by certain types of marine vessel from one port to another is to lift it onto what is termed a cassette, this being a sled platform without wheels, under which may be driven a hydraulically raising wheeled boom that is articulated to what is termed a trans-lifter vehicle.

As with the vertical stacking of cargo containers it is also necessary for safety reasons that mounting-points are available upon a cassette or trailer that can be releasably secured to each of four mounting-points in a rectangular layout at the bottom surface of each container to be transported. It is a regular problem for ports or shipping lines to experience a shortage of trailers or cassettes that are long enough to carry the last remaining containers of a consignment. Any trailers or cassettes remaining available that are shorter than the containers to be carried cannot be utilized with said containers overhanging one end if the rear pair of mounting-points upon each said trailer or cassette will not connect with those on the longer containers.

Owing to the increasing variety of non-standard cargo container sizes, particularly in respect of their lengths, the amount of overhang of a container body beyond one or both ends of its ISO mounting-point layout represents a further planning and logistical problem. Within many trading areas it is impossible to designate the receiving trailers or cassettes in advance of the booked containers' arrival at a port owing to uncertainty as to whether they will be compatible with said containers. For example, a 13.6 m trailer may accept a 6 m container and be designated to also receive an expected 7.45 m, but upon arrival the 7.45 m may be found to have centrally-placed mounting-points, the overhang of its body therefore conflicting with the body of the pre-loaded 6 m so as to prevent it from mating with the trailer's second cell of 6 m mounting-points.

The size of container ships is constantly increasing. Of major concern to the owners of the latest generation of large vessels is the ability of the shore infrastructure to cope with the number of containers involved with each docking and to service the amount of container lifting and transporting necessary within a timeframe that does not negate the benefits of that increased scale. It would be of obvious economic benefit to both the ship and port operators if there was a means of safely lifting a multiple block of containers within a single lifting cycle of a top-lifting crane rather than the lifting of individual containers as generally experienced today.

Vertically stacked containers, even when they are releasably secured together in storage areas ashore, are liable to lateral sway in high winds. Th dangers of lateral sway are greatly increased for stacks upon the decks of marine vessels during storms and, many containers are accordingly lost overboard each year due to the breaking-away of some of the outermost stacks. The bottom two or three tiers of a container stack aboard a marine vessel are often diagonally cross-braced to its deck by manually secured bracing rods but the height to which this is achievable is restricted by safety and practical considerations. Even so, the breaking-away and falling of such rods is a known hazard to shipboard workers.

Vertical securing used to be effected at even higher levels by operatives climbing and walking across the stacks but this dangerous practice has also declined through safety legislation. There is a preference nowadays for twist-lock operatives to be hoisted to the upper containers by crane-lift but it remains a dangerous occupation.

Marine vessels also exist that incorporate racking systems for the lateral and longitudinal retention of stacks of containers, said racking systems being referred-to as cells. These cells comprise vertical uprights positioned at each corner of a stack position such that containers may be guided and craned into each cell therein to form part of a secure stack. These cell guides are of fixed dimensions and accord with the most commonly used container lengths, i.e. 20 ft and 40 ft, often resulting in the inability of shipping lines equipped with such vessels to accept cargo containers of non-standard lengths. This will often mean that operators of such non-standard containers are denied direct access between certain points of the globe and are therefore excluded from some markets or forced to use a relay of indirect connections at a greater cost.

U.S. Pat. No. 6,027,291 discloses, a rack for stacking cargo containers having lateral rails with mounting points on she upper and lower surfaces of the lateral rails. The lateral rails are joined by longitudinal beam.

For the foregoing reasons of safety or efficiency, plus further such considerations herein, them is therefore provided a transport linking frame for the laterally symmetrical vertical linking of one or a linearly aligned pair of cargo containers having a first length or width and having a first layout of mounting-points to one or a linearly aligned pair of cargo containers having a second length or width and having a second layout of mounting-paints, the transport linking frame comprising: two parallel longitudinal beams (11); a plurality of lateral beams (12) connecting the longitudinal beams (11); a plurality of connectors (13) for connecting to containers; characterised in that the connectors are bi-acting connector (13) protruding laterally outwards from the longitudinal beams (11), the bi-acting connectors (13) being spaced longitudinally along the frame to correspond with mounting points of a variety of lay-outs on cargo containers, and the bi-acting connectors (13) including at, least two opposed acting surfaces (51,55) arranged to mate with container mounting points of containers above and below the transport linking frame, said acting surfaces (51,55) containing locking apertures (52) or alternative, containing internal channels retaining a rotatable spindle or spindles having locking-cones (61) at one or each end, each locking-cone (61) having a control-lever (63) enabling it to be rotated.

The ability of a linking frame to connect with a variety of different mounting-point layouts therefore enables it to vertically connect simultaneously with cargo containers of mutually differing lengths and/or widths that cannot otherwise be safely stacked and also permits the linear alignment of containers of different lengths and/or widths such that they may be transported as a combined unit, The standard female mounting-points presently known in the art as fitted to cargo containers are uni-acting, incorporating a locking aperture of standard dimensions in one surface only, that being the upper surface on a mounting-point at the top of a container or being the lower surface on a mounting-point at the bottom of a container. Two adjoining side surfaces normally each include an inspection hole, which is also of assistance for access in the event of a connected locking-cone becoming seized within the mounting-point. The fourth, fifth and sixth surfaces of such mounting-points normally abut with the container. One of said standard uni-acting female mounting-points having a locking aperture in its upper surface may be conjoined with one of said standard uni-acting female mounting-points having a looking aperture in its lower surface and a plurality of said combination may be included within the scope of the present invention to act as dual female bi-acting connectors that are each able to mate with a male locking-cone from above and/or a male locking-cone from below. However, this method may be less efficient and less flexible than other means.

Therefore frames according to the present invention may preferably include a plurality of bi-acting connectors whereof their acting-surfaces are able to correspond, directly by locking-cones and/or indirectly by the use of portable twist-locks, with mounting-points as provided upon the surfaces of a variety of cargo transport equipment. It may therefore, as preferred, be possible to remove the reliance upon, or retain the option of using, portable twist-locks in order to mate bi-acting connectors with said mounting-points. Totally female bi-acting connectors may each therefore also dispense with the thickness of two joined surfaces and the task of conjoining those surfaces as compared with a mating of standard upward and downward uni-acting female mounting-points.

By therefore avoiding the dimensional constraints otherwise imposed by the combined depth of a conjoined pair of standard uni-acting female mounting-points it is also possible to achieve a shallower depth from the upper to the lower female surfaces of a bi-acting connector herein described and enable the framework of the linking frame to which it is to be attached to be constructed to that same shallower depth, it being important to minimize the combined height of stacked cargo containers in operational conditions.

The bi-acting connectors provided upon a frame of the present invention are located so as to protrude beyond the outer longitudinal side surfaces of said linking frame framework. By this arrangement the upper and lower surfaces of said linking frame will separate the vertically adjacent horizontal surfaces of the cargo containers indirectly vertically connected by said frame, thereby providing voids between said surfaces and alongside each bi-acting connector. Therefore it may be possible, when releasably securing said bi-acting connectors of a linking frame to the mounting-points of cargo containers at positions inboard of the longitudinally outermost bi-acting connectors, to operate the locking-cone control-levers of said bi-acting connectors, or standard portable twist-locks mated with said bi-acting connectors, within spaces that provide increased visibility and less restricted entry to the hand than if otherwise the stacked cargo containers were directly secured together.

Each bi-acting connector of a pair of said connectors may be attached protruding outward the outer longitudinal side surfaces of said linking frame framework in a line between them which is at a right angle to the longitudinal line of said linking frame, each bi-acting connector of said pair of connectors being at an equal distance from the center of said framework, the combined said distances being such as to facilitate the alignment and releasable securing of said pair of bi-acting connectors with a pair of mounting-points of a first width as provided upon a cargo container. Each bi-acting connector of said pair of connectors may also or otherwise be conjoined horizontally with a bi-acting connector of an additional pair of connectors, the distance between each bi-acting connector of said additional pair of connectors being such as to facilitate the alignment and releasable securing of said additional pair of connectors with a pair of mounting-points of a second width.

Thereby there may be achieved, for example, a cargo container of a first width or a linearly aligned and laterally symmetrical pair of containers either or both of which being of a first or a second width releasably secured to and in lateral symmetry with a first horizontal surface of said linking frame, said combination being laterally and longitudinally symmetrical with a container of a first or second width or a linearly aligned pair of containers either or both of which being of the first or second width that is/are releasably secured to and is/are in lateral symmetry with the second horizontal surface of said linking frame.

Therefore, for example, there may be releasably secured to either or both of the horizontal surfaces of a linking frame a first cargo container of a first width and a second cargo container of the first or a second width.

Owing to the shallow depth of a transport linking frame in comparison to a cargo container it may be possible for an operative to easily access and prepare said frame's bi-acting connectors or therein mated portable twist-locks in advance of a lifting operation whilst it rests, for example, upon the ground or upon a low support or upon of a small stack of other empty linking frames.

When used to facilitate the stacking of cargo containers a linking frame of the present invention may first be lifted atop what will be the lower container or linearly aligned pair of containers. Bi-acting connectors amongst several on the linking frame that are laid out and have lower surfaces so as to correspond with mounting-points of various layouts at the top surfaces of cargo containers may then be releasably secured to the corresponding mounting-points at the top of said lower container/s.

A cargo container or linear pair of containers that may not or otherwise possess enough mounting-points that are co-operable with those of the lower container or containers may then be lifted atop the linking frame. Bi-acting connectors amongst several on said frame that are laid out and have upper surfaces so as to correspond with mounting-points of various layouts at the bottom surfaces of cargo containers may then be releasably secured to the corresponding mounting-points at the bottom of said topmost container/s.

New lifting sequences may therefore be employed that reduce the amount of climbing up to the mounting-points of the containers or the need to stand close to a suspended container. Whilst the linking frame is on the ground or upon said low support and the locking-cones of appropriate upward-acting surfaces of connectors or therein mated portable twist-locks upon said linking frame are in the 'receiving' position the intended topmost container or containers may first be craned onto said linking frame, the operative, at ground level, then locking the male locking-cones at the upward-acting surfaces of said bi-acting connectors or therein mated twist-locks. This combination of container/s and linking frame may then be lifted onto the receiving container or linear pair of containers, the operative then climbing up for the only occasion in order to lock the male locking-cones at the lower surfaces of said bi-acting connectors of the linking frame or therein mated twist-locks.

The climbing of containers may be further reduced and manual access to twist-locks in the dangerous confines between adjacent stacks of containers may be totally avoided by the provision upon or within a linking frame of a connecting-rod system to connect the control-lever of each male surface of a bi-acting connector on one side of a linking frame to the corresponding control-lever of the male surface of a bi-acting connector laterally and concentrically opposite to it, on the opposite side of said linking frame, so that said control-levers may be locked or unlocked simultaneously from either side of said linking frame.

In some circumstances, for example on some marine vessels, it is even difficult to gain access to one side of a container and access has to be from one end. Therefore a linking frame of the present invention may incorporate a connecting-rod system affixed externally to or internally within each outer longitudinal beam that may be operated by a lever or levers from either end of said linking frame so as to simultaneously operate all or a proportion of locking-cone control-levers upon the male acting surfaces of bi-acting connectors protruding from said beam or beams.

By said connecting-rod methods there may be possible safer procedures for the locking together and unlocking of vertically stacked containers. Said method may also facilitate stacks being able to be positioned closer together, because access may then only be necessary from one side or end instead of both. There may also be less reasons or excuses for operatives to partially secure containers together in unsatisfactory manner such as, for convenience or through lack of sufficient twist-locks, at only two diagonally opposed corners instead of between all four pairs of corresponding mounting-points.

The lifting sequences herein described for stacking of containers by the use of linking frames of the present invention result in the beams and bi-acting connectors of said frames only having to resist downward pressure from the weight of containers upon them and to resist longitudinal and lateral motion during transportation. However a linking frame may also be provided with sufficient strength to enable a container or linear pair of containers releasably secured to the lower surface of said linking frame to be suspended beneath it whilst a standard lifting device lifts said combination after conveniently securing with four bi-acting connectors at the upper surface of said linking frame or with other lifting means provided upon said linking frame.

Frames of the present invention constitute a less technical alternative to facilitate the lifting of linear pairs of containers than the lifting device attachments presently known as adjustable twin spreaders, said invention also, when provided with appropriate types and layouts of bi-acting connectors, furthermore enabling the lifting of containers having non-standard widths.

The ability of a linking frame to satisfactorily suspend a linearly aligned pair of containers beneath it is due to more factors than simply its strength. Upon lifting cargo containers there must be no tangential strain upon their mounting-points, which are known to be the weakest elements of the equation. During a suspended lift all four mounting-points at the top of each container must be connected to the lifting device and the lifting must remain at a constant perpendicular angle. The present invention is able to fulfil said requirements.

It was previously expressed herein that it would be economically beneficial to be able to safely top-lift a multiple combination of containers within a single lifting cycle of a crane. The kinetic strength of the top mounting points of the upper tier of containers in such a combination is the governing factor in the achievement of such lifting but there is strength available to be used. To make maximum use of this strength it is paramount that tangential strain be avoided and there are certain combinations of mixed sizes of containers that during top-lifting would definitely incur too much such strain upon their mounting-points to be practical or safe. Examples of this are 2×linearly-aligned 20 fts beneath a 40 ft, 2×linear 20 fts beneath 2×linear 20 fts (if lifted conventionally at four mounting points), a 40 ft beneath 2×linear 20 fts (irrespective of lifting points, because the 40 ft cannot support the 20 fts at rest).

By securing of the first tier of containers to the upper surface of a linking frame and the second tier of containers to the lower surface of the same linking frame all the combination lifts described above could take place, subject to the overall weight of the combination pulling downward at the upper containers' mounting-points remaining within their kinetic tolerance and also subject to the cargo weight distribution being in balance. Furthermore, the example of 2×20 fts suspended beneath 2×20 fts (the only example achievable with present technology, but requiring a twin-spreader) would be achievable by use of a linking frame of the present invention, dispensing with the need for a twin-spreader and its connection with the eight uppermost mounting-points. Whenever said pairs of 20 ft containers are fully secured above and below a linking frame a standard lifting device need only connect to the longitudinally outermost top two pairs of mounting-points upon the top tier of containers as this will take the stresses to the eight bottom mounting-points attached to the linking frame and away from the unsecured longitudinally innermost top two pairs.

The above examples demonstrate the difficulty of achieving multiple lifts even with standard 20 ft and 40 ft ISO units of the same length, width and height. As mentioned previously herein there is a wide range of container sizes passing through each stage of a transport chain so the achievement of satisfactory multiple lifts of different-sized containers is at the same time both desirable but, using existing technology, even less likely to occur than the relatively straightforward examples given herein. A linking frame however, with its ability to connect containers of differing lengths, gives the same possibilities for lifting non-standard lengths as it does for standard 20 ft and 40 ft equipment.

With the need for perpendicular lifting to avoid tangential strain upon container mounting-points during a combined lift the cargo weight distribution within the containers would be an important consideration but this may be overcome by adequate documentation or other means of advice to ensure that the parameters were not exceeded.

The top-lifting of combinations of empty containers is also a desirable goal and is more easily attainable. In this respect the weight considerations are less severe and much can be achieved by the use of linking frames in the manner herein described. The tare weight of the various empty container types will be evident and become routinely appreciated by the lifting supervisor. Instead of having to consider cargo weights he may assemble an acceptable combination of empty containers for a combined top-lift by arranging their distribution above and below a linking frame according to lateral and longitudinal symmetry, such symmetry being achievable with pairings of containers connected to both horizontal surfaces of a linking frame, irrespective of differences in container lengths or widths between the upper and lower tiers.

The possibility of top-lifting double-tiered containers, wherein the bottom containers are suspended by twist-locks joining them to the top containers, is the subject of long-standing debate between commercial interests and safety legislators. The safety authorities have two main considerations, one being the kinetic strength of standard container mounting-points, wherein age deterioration is a factor, the second being the type and strength of twist-locks to be employed, which are difficult to legislate-for and to routinely inspect considering their variety, size, daily abuse and propensity to be easily lost.

Using linking frames to link between upper and lower containers leads to the further advantage of said frames being provided with bi-acting connectors having male locking-cones strong enough to safely suspend a lower tier of containers beneath an upper tier. A frame of the present invention will also be capable of carrying a readily identifiable serial number and therefore of being certified as a lifting apparatus, along with the routine maintenance and inspection disciplines arising to regularly validate said certification.

A linking frame of the present invention will incorporate longitudinal and lateral beams of a length, width and depth as required to resist the weight of a cargo container or containers and to support that weight between the mounting-points at the top surface or surfaces of the lower container or containers onto which said frame may be releasably secured, and as such will tend to be too heavy for easy manual handling. Therefore said frame may be provided with means enabling it to be lifted by forks as fitted to fork-lift trucks and/or there may also be incorporated, upon each of its sides, two ridged pockets enabling it to be lifted by rigid perpendicular lifting arms as may be fitted to fork-lift trucks and to cranes.

A derivative advantage achieved by a frame of the present invention being provided with fork-lifting means and/or ridged lifting pockets is that a combination of containers releasably secured to said frame may be lifted in one movement by a fork-lift engaging with said fork-lifting means or ridged pockets, or by a crane engaging with said ridged pockets, this being of particular benefit when said containers do not themselves incorporate fork-lifting means or ridged pockets. These increased lifting options may also reduce the number of lifting tackle changes required upon fork-lifts and/or cranes during the continuous lifting of a variety of cargo container types.

Another advantage achieved by a frame of the present invention incorporating said fork-lifting means and/or ridged lifting pockets is that by these means a fork-lift or crane may connect directly to the linking frame and therefore avoid contact with the mounting-points of any containers releasably secured to the upper surface of said linking frame. Therefore the mounting-points at the top surfaces of any containers that are secured to the lower surface of the linking frame will become the first mounting-point suspension positions for bearing the weight of said containers, as opposed to otherwise the topmost mounting-points of the upper containers whenever top-lifted in conventional manner by a crane. Such a combination utilizing a linking frame will therefore be able to tolerate a weight of cargo in the top tier of containers unrestricted by considerations of kinetic stress to their mounting-points. Likewise the lower tier of containers suspended beneath the linking frame may also carry a cargo weight unaffected by stress limits to the mounting-points of said top tier of containers.

Another advantage of a crane or forklift being able to connect directly to the linking frame is that otherwise, whenever two short-length containers vary in height, it would not be possible to achieve the simultaneous lifting of such a pair because the lifting points of a crane or spreader beam could not connect evenly with the upper mounting-points of the taller-height container and those of the lower-height container so as to be able to conduct a symmetrical and therefore safely balanced lift. By connecting such a pair of containers to the upper surface of a linking frame and lifting directly from said frame the differing container heights will be of no consequence in the achievement of a balanced lift and therefore no time will be lost in searching for or waiting for pairs of containers of matching heights to assemble a combination for lifting.

A linking frame of the present invention may be manufactured in a range of sizes, thereby the problem of different heights between short-length containers that prevents them from being top-lifted together by their upper mounting-points or prevents them from receiving a longer container stacked on top of them may be overcome by connecting a linking frame of an appropriate length and depth to the upper surface of the lower-height container so that said frame's upper surface is horizontal to that of the taller container. The same method may be employed when said containers are to be connected to a cargo container transport, but in that case said linking frame may be alternatively connected to the surface of said container transport in advance and then receive the lower-height short-length container on top of it, thereby equalizing the height with the taller short-length container and providing a horizontal surface for the receiving of the longer container on top of them.

A yet further advantage related to the provision of ridged pockets or fork-lifting means upon a linking frame may be observed in a variety of transport depots, ports or storage locations where there are many equipment handling tasks that would be resolved or simplified by the provision of mobile cranes and/or twin spreader beams but the cost and maintenance of same and their attachments is often found prohibitive. Fork-lift trucks however may normally be found at such sites as a matter of routine necessity. By the employment of a linking frame of the present invention equipped with fork-lifting means it will be possible, for example, for a fork-lift to lift said frame to the top of a container or pair of containers that are not equipped with fork-lifting means, then after releasable securement of the bi-acting connectors of said frame to the corresponding mounting-points upon the container/s to lift said container/s to or from a cargo container transport and/or a storage area.

It will also be possible to use said method to lift, move and, if required, stack container-trailers for the common practice of their doubled or trebled empty transportation instead of using vehicles to mount them together by driving them up ramps or using the forks of a fork-lift truck to negotiate each trailer's chassis components and find a safe point of balance. Such trailers are normally equipped with male mounting-points, therefore in this case it would be preferable to use a linking frame having bi-acting connectors provided with female downward-acting surfaces.

The dangers associated with using portable male twist-locks for the securing together of cargo transport equipment under often arduous and constrictive conditions, along with questions as to their suitability and strength, may be completely avoided by the use of a linking frame equipped with totally male bi-acting connectors.

Whenever it is preferred to employ linking frames provided only with male bi-acting connectors there may be difficulty when a crane, normally also having male lifting-points, needs to directly connect with one of said frames. This may be overcome by affixing male connectors to said frames so that when necessary they may be removed and replaced with female connectors.

Alternatively, four connectors having female bi-acting surfaces may be provided at craning positions offset from the predominantly male connectors to facilitate craning from those positions or so they may be slid into appropriate craning positions from which male connectors have been slid away.

An option of being able to remove and replace bi-acting connectors of a linking frame will be beneficial when any are in need of repair or whenever there is a shortage of portable twist-locks for mating to female connectors. There may also be an economic advantage through affixing only the minimum number of bi-acting connectors required for a specific and repetitive stacking operation.

Said option to remove and replace bi-acting connectors of a linking frame may also add to the flexibility of said frame in that it may be adapted from one type of securing and/or lifting function to another by the re-positioning of bi-acting connectors to different positions or by exchanging bi-acting connectors of one gender or mix of genders for another.

Said option to remove and replace bi-acting connectors of a linking frame leads to the ability to remove a connector, turn it 90, 180 or 270 degrees and re-affix it such that it becomes totally passive or has a changed sequence of vertically perpendicular acting-surface genders.

Said option to remove and replace bi-acting connectors of a linking frame also leads to the ability to replace bi-acting connectors that are designed to protrude so as to correspond with containers of a first width with bi-acting connectors that are designed to protrude so as to correspond with containers of a second width. Alternatively, extension means may be placed between or be removed from between bi-acting connectors and the linking frame to which they are connected so as to increase or decrease the width between their acting-surfaces and the outer side surfaces of said linking frame, thereby increasing the range of container widths to which they may correspond.

An option to unlock a bi-acting connector installed upon a linking frame, rotate it upon a central axis and then re-lock it will also add to the flexibility of said frame, enabling it to adapt from one type of securing and/or lifting function to another. The term 'bi-acting connectors' used herein refers to the ability of said connectors to be releasably secured to container mounting-points simultaneously or independently, upwardly and downwardly. As described by the drawings herein, different versions of bi-acting connectors may exist that include acting-surfaces at four positions, two of which acting-surfaces are horizontal and passive until rotated to vertical in order to take the place of the two previously active acting-surfaces. By this means additional versatility may be incorporated within each bi-acting connector position upon a linking frame, increasing the range of tasks upon which said linking frame may be employed.

Furthermore, said method will enable the locking-cone of any male acting-surface protruding inconveniently from a position where there is no corresponding mounting-point upon a cargo container about to be secured to said linking frame to be rotated away from that position and to be replaced by a female acting-surface able to lie passively and flush against the horizontal surface of said container.

It is preferred that male locking-cones upon the surfaces of portable twist-locks presently known in the art stand permanently proud of said surfaces and are supported upon a raised metal plinth, thereby serving as points of aim to the drivers of container lifting devices and at the same time being durable enough to take the shock of container weights catching them during setting-down by the cranes. Male acting surfaces of bi-acting connectors as referred-to herein may be provided with said type of cone but may also be alternatively provided with locking-cones that may be lowered flush with and thereafter raised above said surfaces by the perpendicular action of their control-levers, such dual-action cone locking/raising mechanisms being already known in the art as commonly provided upon road-going container-trailers.

The said method of being able to rotate bi-acting connectors, and each being provided with two pairs of opposed acting-surfaces, leads also to the ability to rotate and therefore interchange a pair of said acting-surfaces set at a first lateral distance relative to the linking frame framework with a pair of acting-surfaces set at a second lateral distance relative to said framework, thereby enabling a second width of said acting-surfaces to be releasably secured with containers of a different width to those of the first width of acting-surfaces.

An option of being able to longitudinally slide male and female bi-acting connectors of a linking frame will be economically beneficial by allowing a reduction in the number of said connectors required upon the frame to the minimum foreseen as necessary for securing together the majority of transport equipment combinations expected in a particular working environment Bi-acting connectors affixed so as to protrude outward the longitudinal outer side surfaces of a linking frame framework may also be affixed so as to slide laterally away from and/or towards said side surfaces, thereby increasing or decreasing the width between laterally-opposed connectors and facilitating their securing with narrower or wider mounting-point layouts upon different sizes of containers. This may be achieved for example by affixing said connectors to sleeves sliding upon lateral beams or affixing them to lateral beams emanating from and sliding through retaining shafts.

The herein claimed protrusion of bi-acting connectors outward the side surfaces of a linking frame leads to all three side surfaces of each said connector being exposed to view. Thereby the three said side surfaces of a totally female bi-acting connector upon a linking frame may each or otherwise incorporate an elongate inspection hole, each of which being long enough to provide simultaneous access to each locking aperture at an upward-acting and at an opposed downward-acting surface of said connector. Alternatively, one or more of the sides of a bi-acting connector having one or more female acting-surfaces may be provided with rectangular inspection holes adjacent said acting surface/s. Combined with the voids maintained alongside the inspection holes of said connectors at all times these features will prove useful during the regular need to free seized twist-locks in otherwise awkward physical circumstances.

Improved stabilization of container stacks may be achieved by securing upon or within said stacks linking frames provided with anchorage points to which may be secured one end of a portable securing means, or otherwise said frames being provided with permanently-affixed flexible or rigid securing means, either of which means may extend from the sides and/or front and/or rear vertical surfaces of said frames and/or exit apertures thereupon, the outward end of each such portable or permanently-affixed means being releasably securable to the mounting-points of adjacent containers or receiving and/or locking means upon adjacent linking frames or upon the decks and/or bulkheads of marine vessels.

An example of a portable securing means may be a tightening lashing bar with hooks at each end. An example of a permanently-affixed flexible securing means may be a tensioning ratchet that allows a length of chain or wire to be withdrawn from it, attached to the end of which being a hook and locking-clip or means such as a twist-lock device. An example of a permanently-affixed rigid securing means may be an arm connected to the linking frame by a hinge or ball-joint, the outward end of said arm being provided with a mounting-point that may be rigid or hinged upon said arm.

By these means linking frames situated upon or within stacks of containers may add lateral stability to said stacks and in particular may substantially increase the anchorage of the outermost stacks of containers aboard a marine vessel, these being the most exposed to possible loss overboard during the pronounced rolling experienced during a storm.

Linking frames having stabilizing means as described herein may also be used to secure containers that are loaded on trailers or cassettes directly to strengthened fittings on the decks or bulkheads of ships, instead of or supplemental to the traditional use of loose lashing chains, which have to be dragged into position, be affixed at each end and then tensioned-down. This latter activity carries one of the highest accident ratios in the dock industry but the linking frame method may lend itself to a more self-contained and tidier operation, thereby being a basis for on-going safety development, as well as offering the potential for faster securing and less labor.

A frame of the present invention may also be employed upon marine vessels having cellular loading racks to support stacks of containers. A linking frame may be provided with the same profile at each end as the profile at each end of the base of an ISO conformity container, thereby resulting in said linking frame being compatible with the vertical uprights of said cells. Therefore a linking frame will be able to combine containers together so that they may be lifted into and out of said cells within a single lifting cycle of a shore crane.

The method described in the preceding paragraph will also permit, for example, containers of an individual length of between 20 ft and less than 40 ft, or a combined length of between 20 ft and 40 ft to be loaded into a 40 ft cell by way of said containers connecting to the upper surface of a 40 ft long linking frame, said frame thereby acting as a support platform, guide and stabilizing means within said 40 ft cell. This will result in cargo containers that have non-standard lengths, or that have additional equipment protruding from one or both ends, such that they cannot presently be accepted for shipment between certain areas of the world, being provided with access to new markets.

A linking frame of the present invention may be used to extend the loading length and/or width of a cargo container transport, for example a trailer or cassette. Said linking frame, being provided with sufficient bi-acting connectors able to be releasably secured to four corresponding mounting-points of said transport and also to all mounting-points at the bottom of a container or linear pair of containers, will be able to extend the transport's loading area longitudinally and laterally according to the limits of safe and practical overhang without the need to otherwise adapt said transport or to fit additional mounting-points beyond a minimum requirement of four.

Container lifting and transporting devices known as gantry cranes and straddle carriers are used within many ports to top-lift and move containers. These generally carry one container at a time despite there being room between one such container and the ground to accommodate a second container. From the methods previously explained herein concerning new lifting sequences made possible by the present invention it will be appreciated that such a container lifting and transporting device will be able to place a first container upon a linking frame provided with bi-acting connectors having male acting surfaces that are self-locking under pressure from container mounting-points. Said combination may then be quickly placed and self-locked onto a second container or linear pair of containers, said combination of vertically stacked containers then being transported and deposited either for a subsequent combined single lift or for an operative to unlock the bi-acting connectors in due course. Thereby there will be no need for an operative to work underneath such vehicles or have to fit portable male twist-locks between said containers.

Said self-securing technology is already known in the art incorporated within some designs of portable twist-locks and being termed 'semi-automatic' action. Said technology and any other suitable mounting-point securing technology may be included within the acting-surfaces of bi-acting connectors attached to frames of the present invention.

Transport linking frames may add yet further efficiency to inter-modal transport in that they may themselves also be used for the carriage of general cargo when not otherwise required to link containers or act as lifting frames.

Although cargo of long lengths may easily be supported by the lateral beams of a linking frame the upper surface of said frame may be further provided with a floor of steel mesh or other material, provided that the upper surface of said floor is no higher than flush with the uppermost acting-surfaces of the bi-acting connectors attached to said linking frame and thereby remain unimpeded in their action. By this means it may be possible to load smaller items of general cargo that would otherwise fall between the lateral beams.

The upward-acting surfaces of the bi-acting connectors of a linking frame may also act as receivers for posts as may be provided with a compatible mounting-point at one end. By this means such posts may act as cargo retainers and also be fitted with connecting points to which fences, headboards, tailboards and canopies may be attached. Lashing points and/or ratchet devices may be provided upon the framework of a linking frame to facilitate the securing of cargo and/or to facilitate the securing of said frame to other objects and surfaces as may be beneficial during transport and storage.

Therefore, linking frames are able to fulfil the tasks of conventional cargo platforms they are additionally able to divert to completely different tasks for which the conventional means are not equipped. Furthermore, such linking frames may effectively transcend different industries because of their ability to carry cargo by road, rail and sea, then when empty, move on to securing and lifting tasks in a different environment.

The technical descriptions and methods of use explained herein reveal that a linking frame of the present invention and the cited attachments thereof may provide, for example, shipping, haulage, railway and stevedoring companies with a device able to improve safety and also fulfil a multiplicity of roles, being capable of easily switching between said roles and thereby ensuring minimal turnaround time, i.e. unemployed time, between the wide choice of tasks to which said invention may be directed.

In order to achieve a better understanding, but by way of example only, the present invention will now be described with reference to the accompanying drawings in which.

Figure 1:
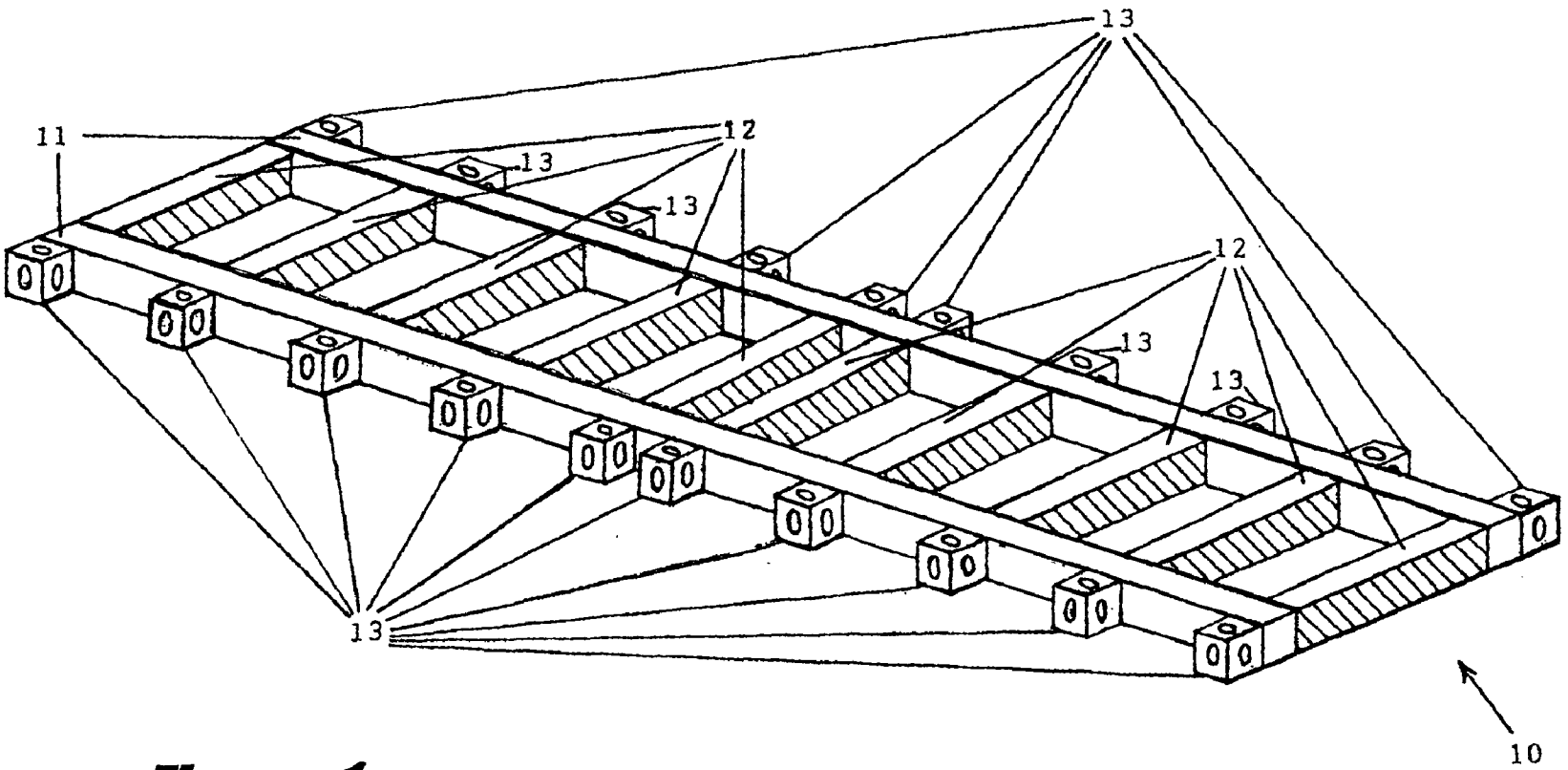
FIG. 1 is a perspective view of a frame of the present invention.
Figure 3:
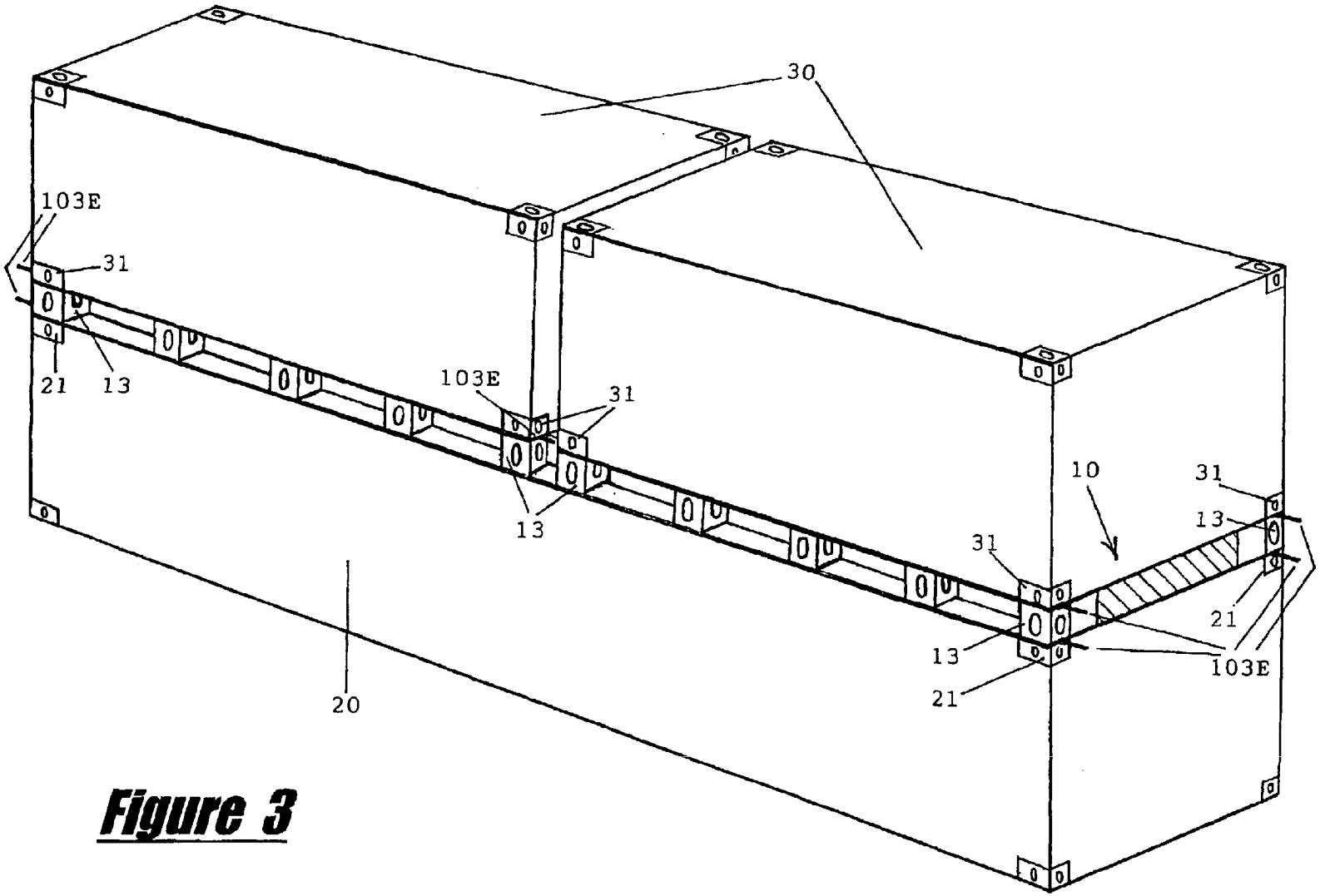
Figure 4:
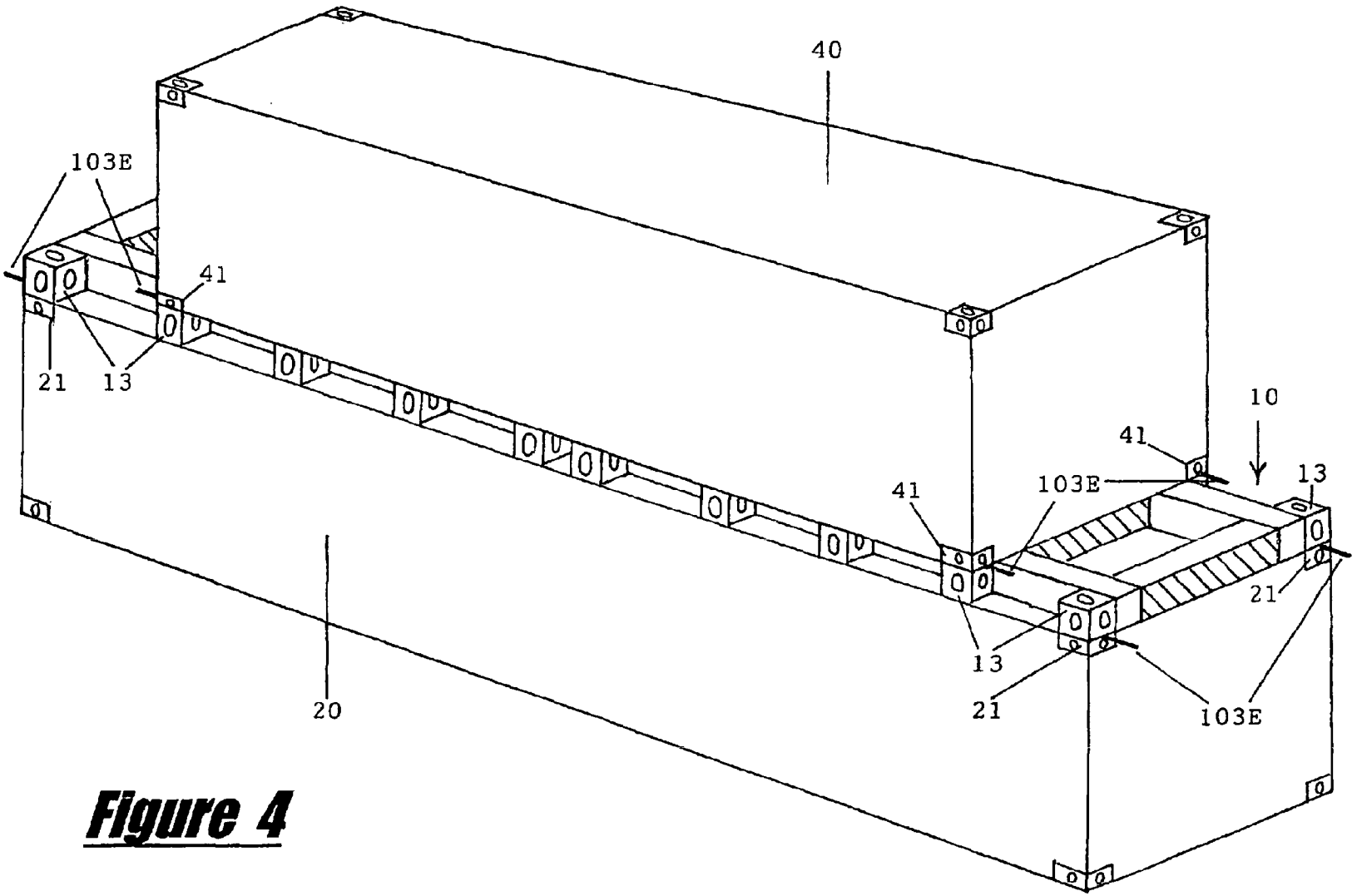
Figure 5A:
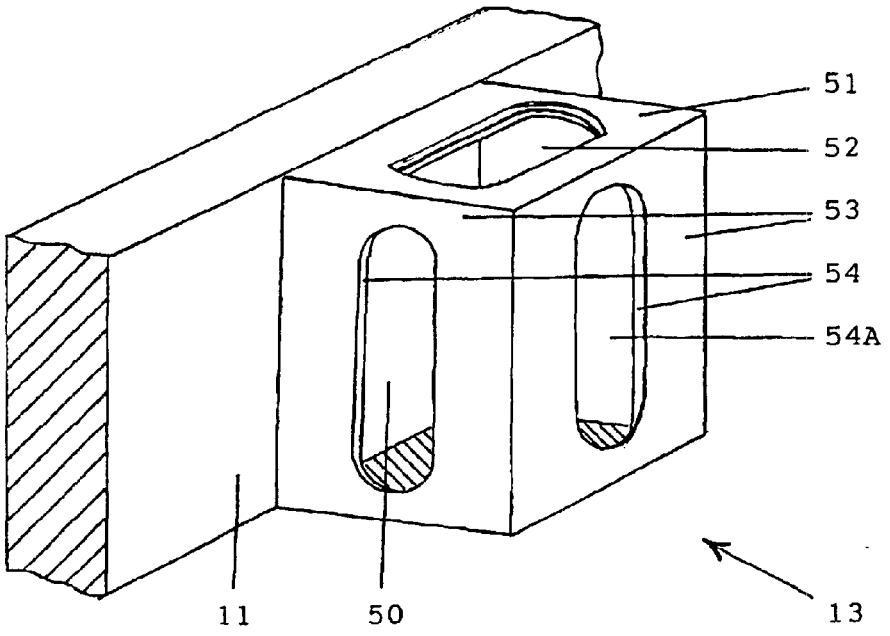
Figure 5B:
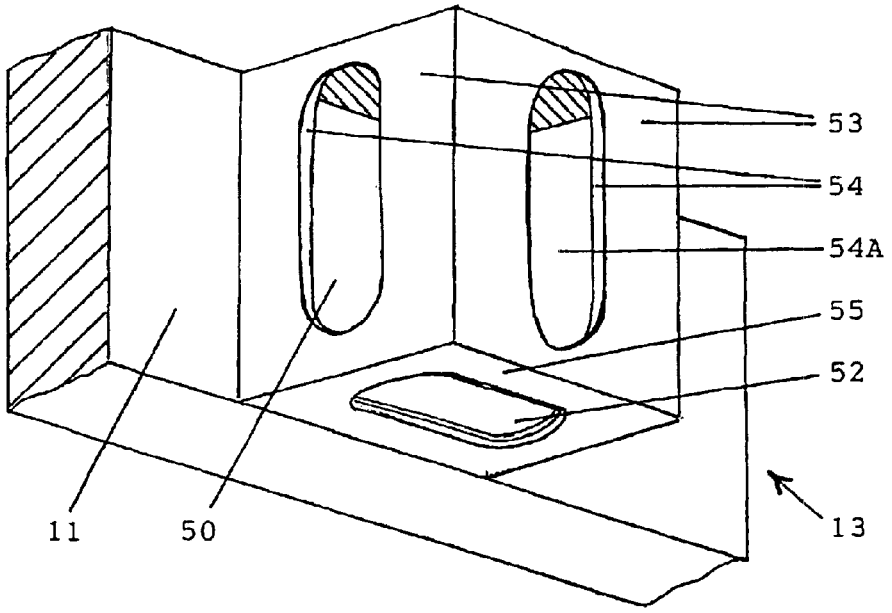
Figure 6:
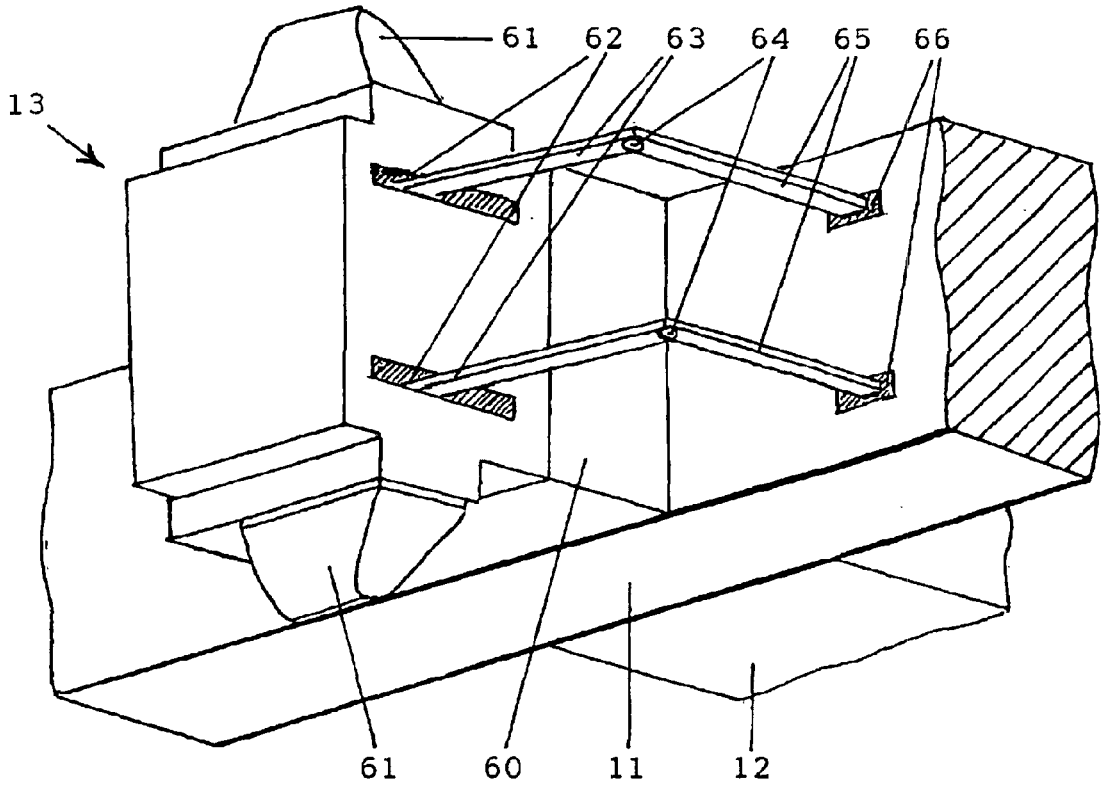
Figure 7A:
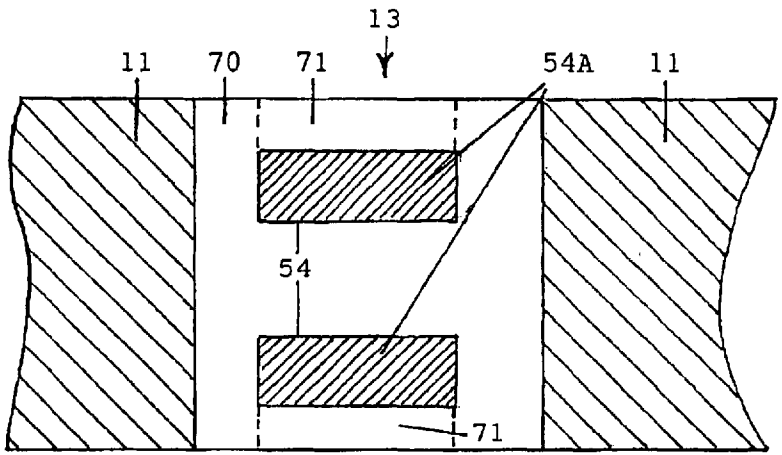
Figure 7B:
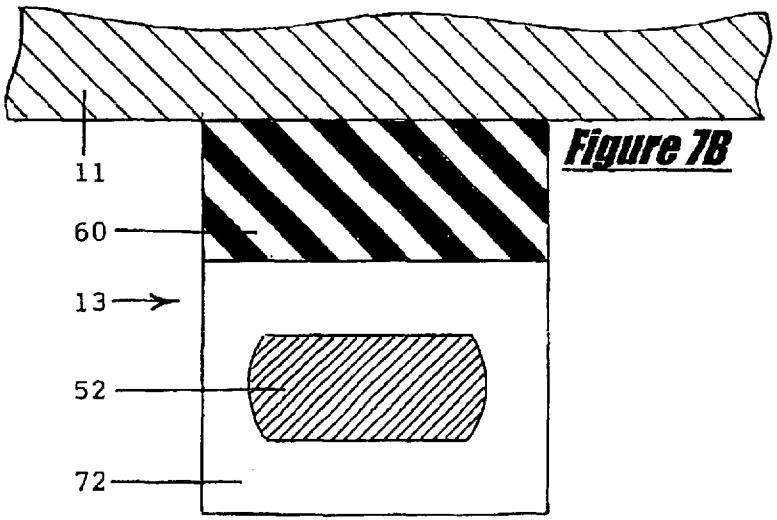
Figure 7C:
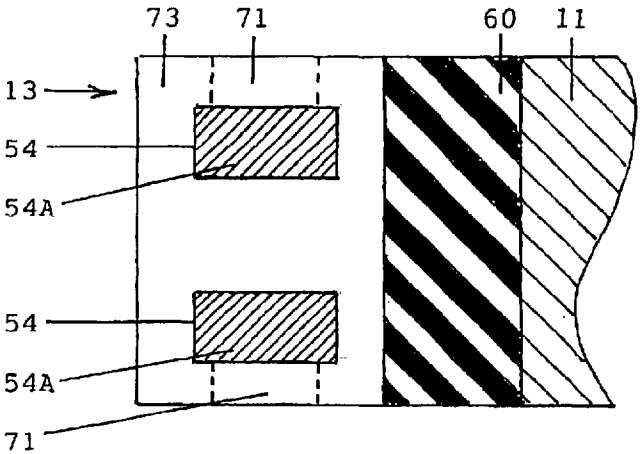
Figure 7D:
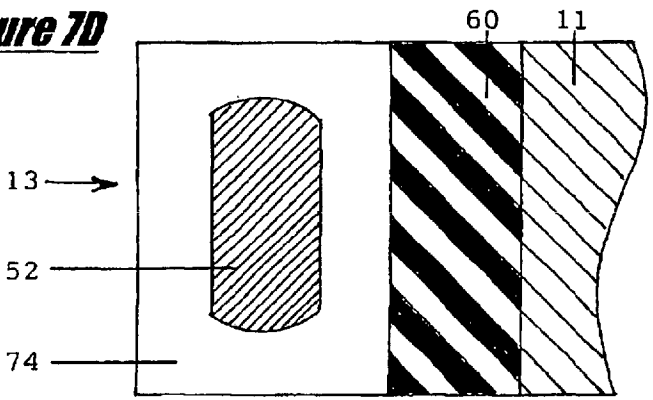
Figure 8B:
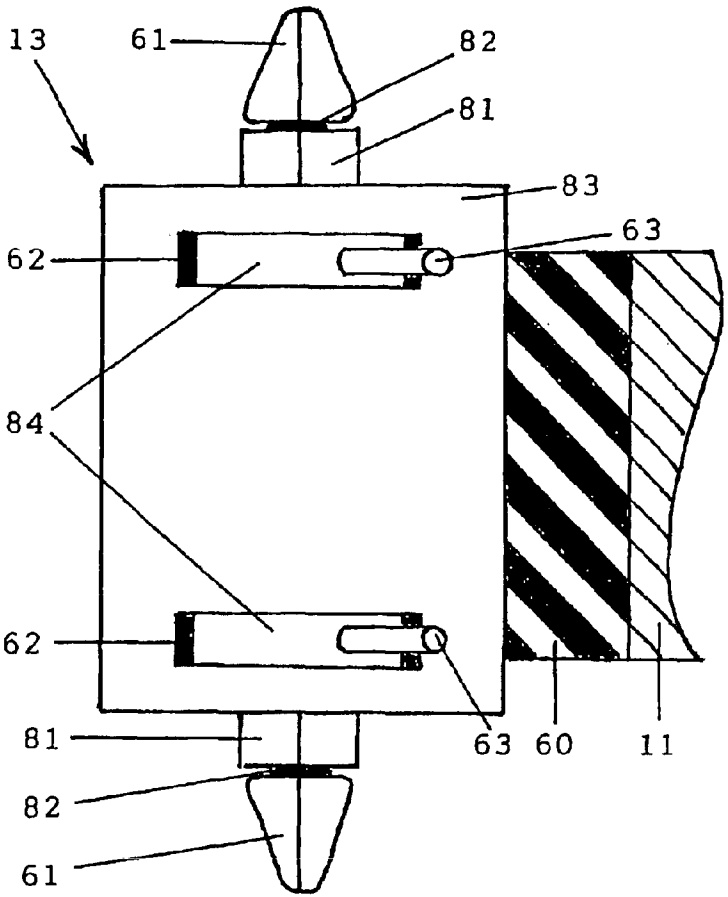
Figure 8A:
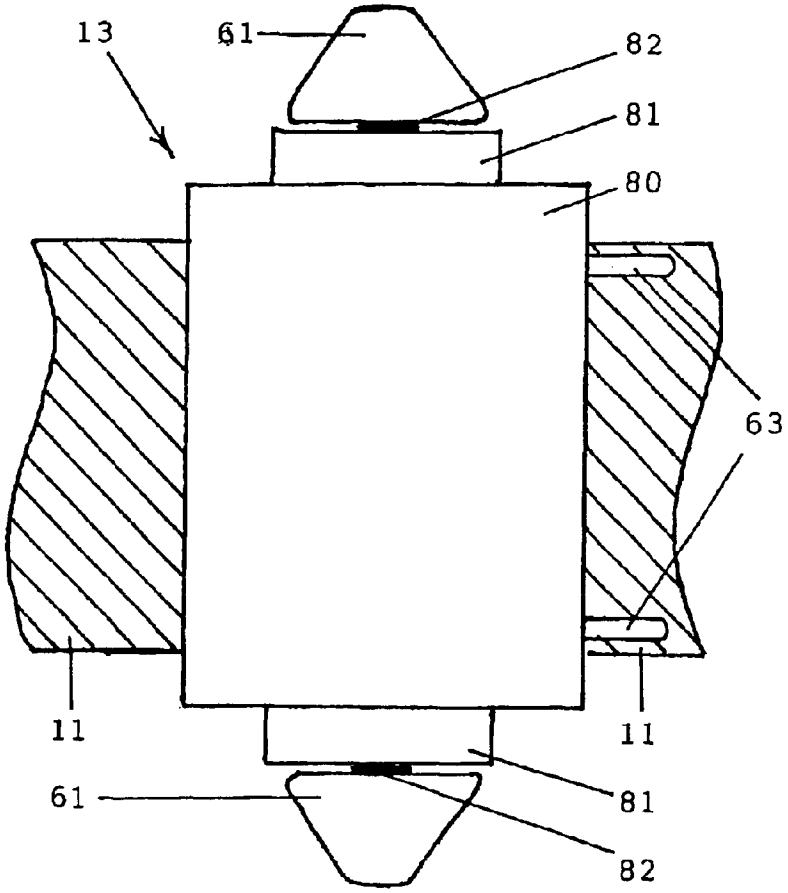
Figure 9B:
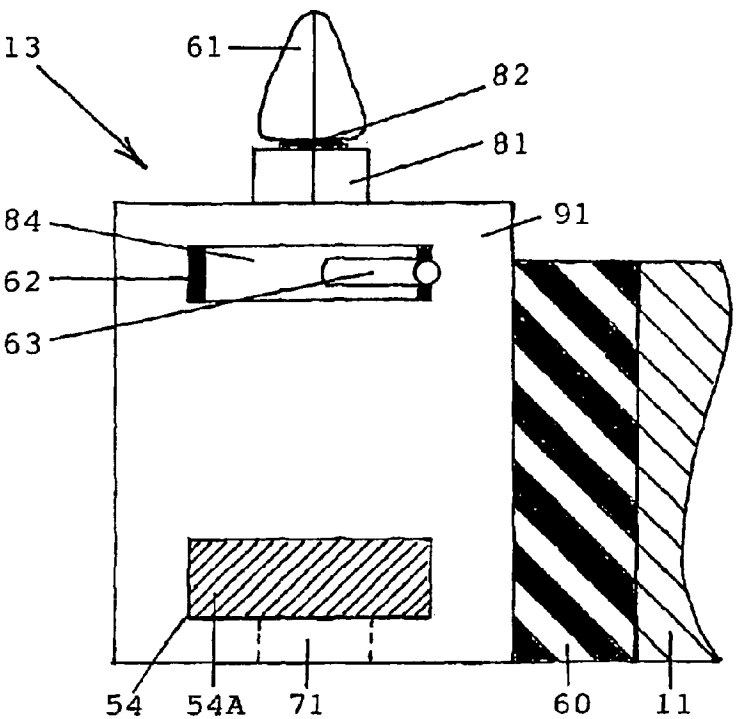
Figure 9A:
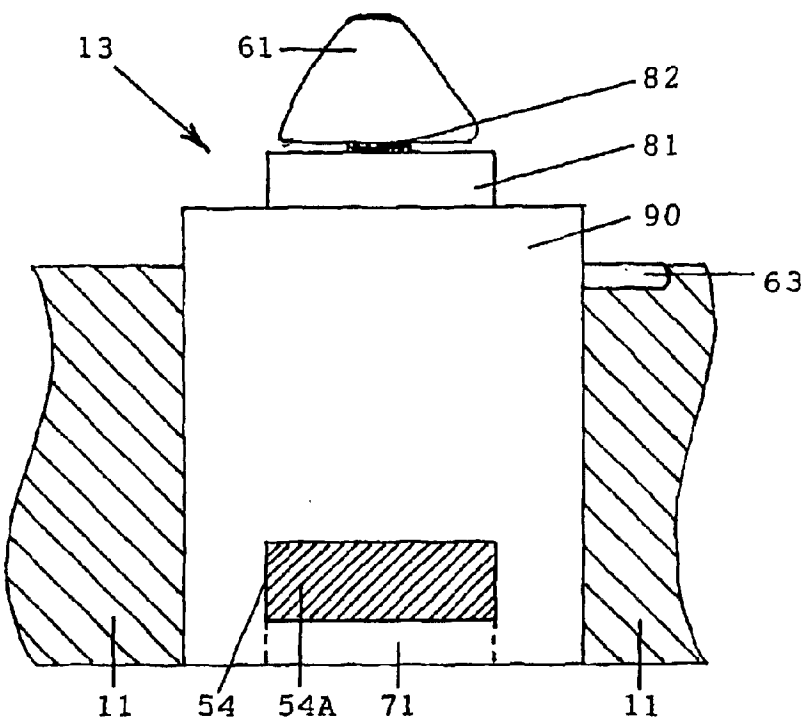
Figure 10B:
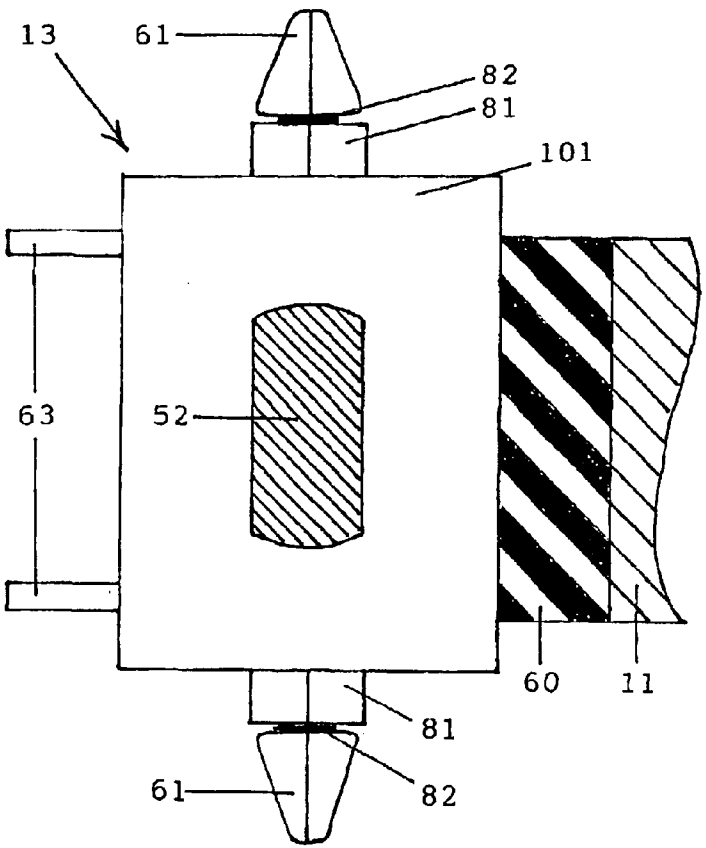
Figure 10A:
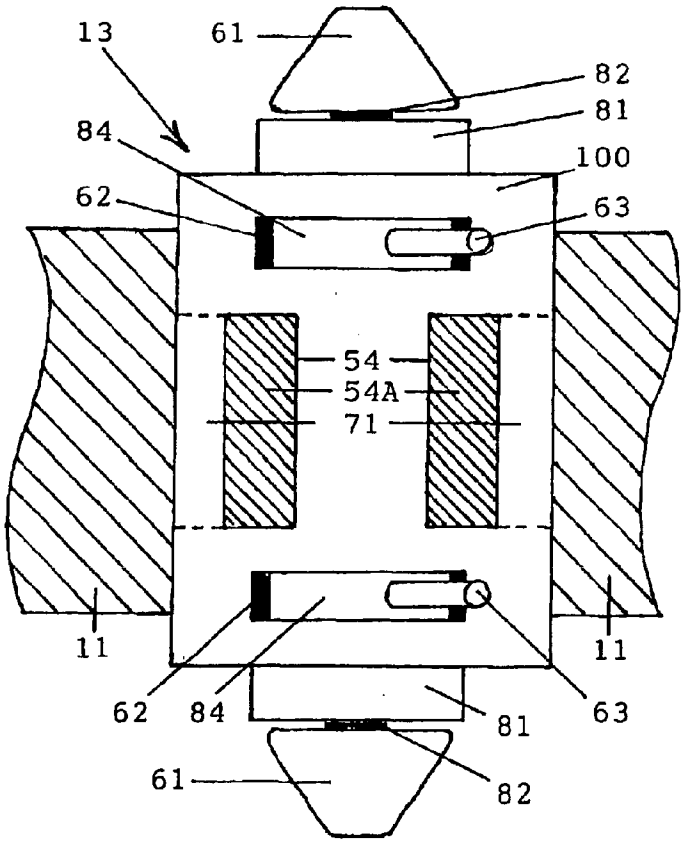
Figure 10D:
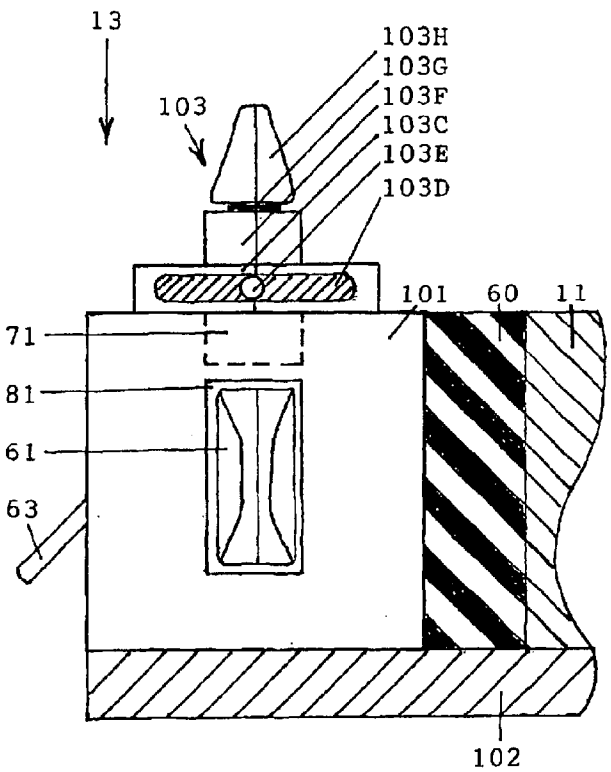
Figure 10C:
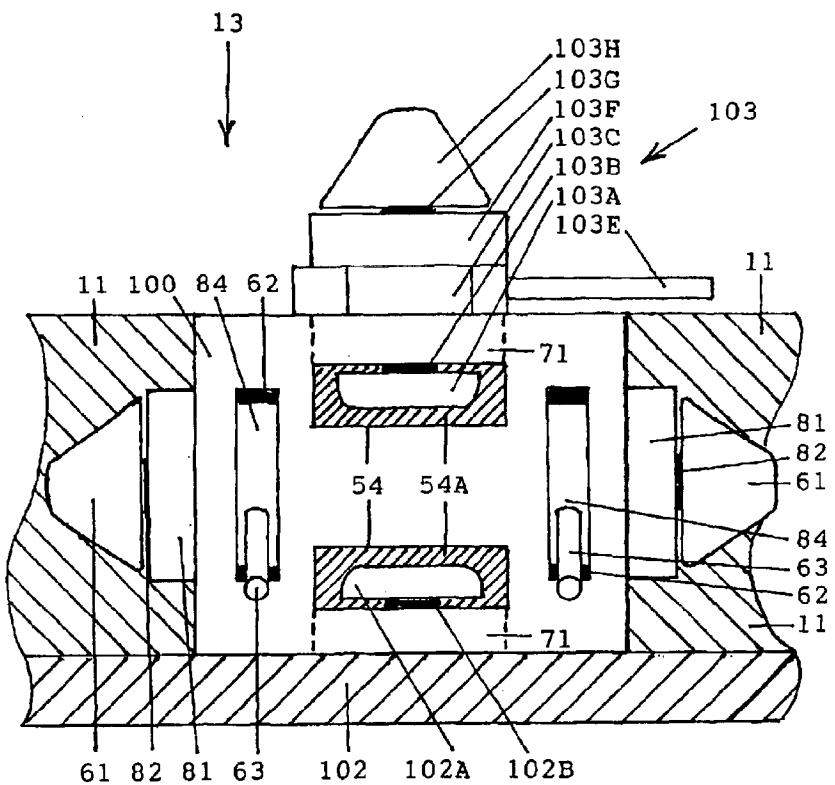
Figure 11B:
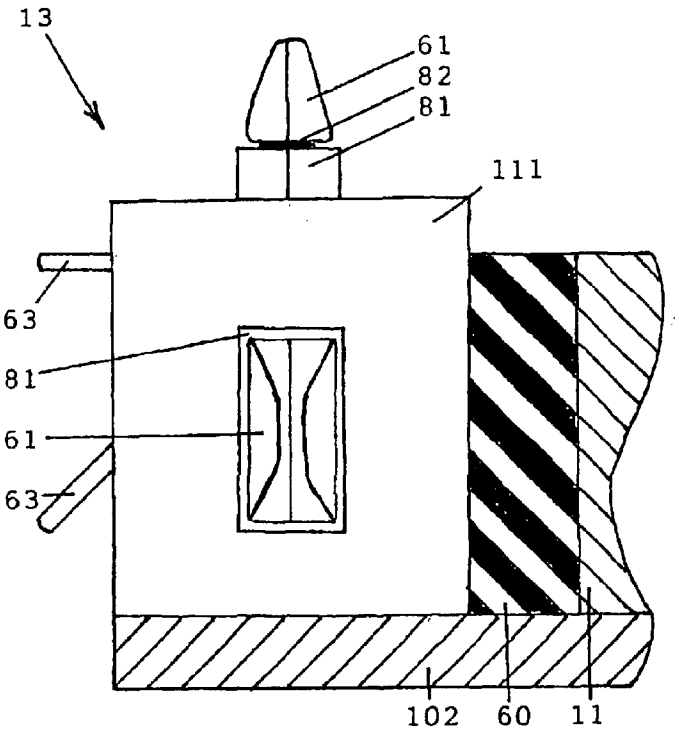
Figure 11A:
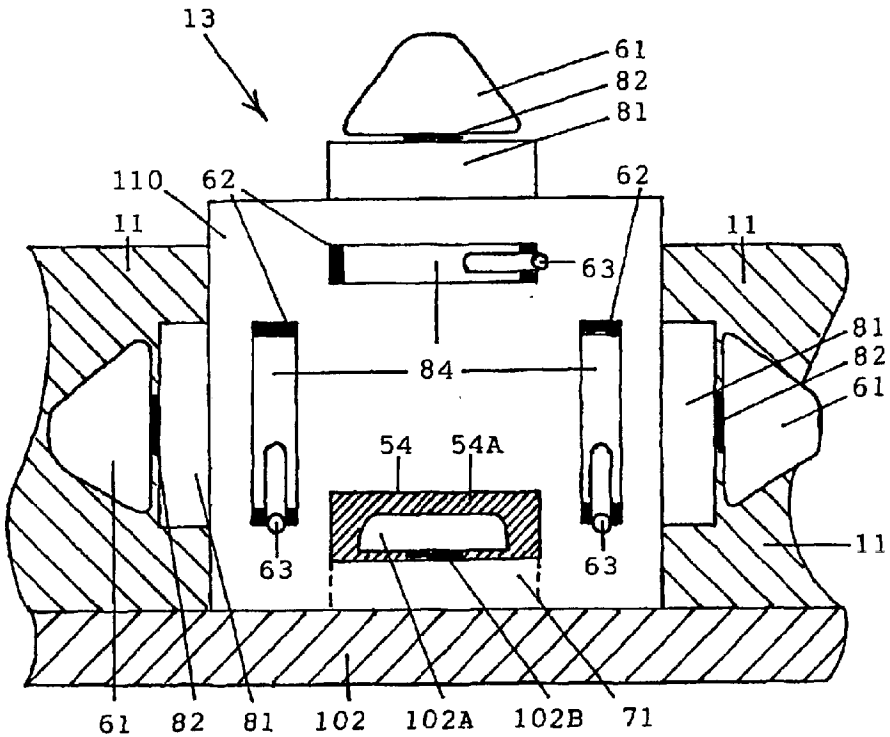
Figure 12B:
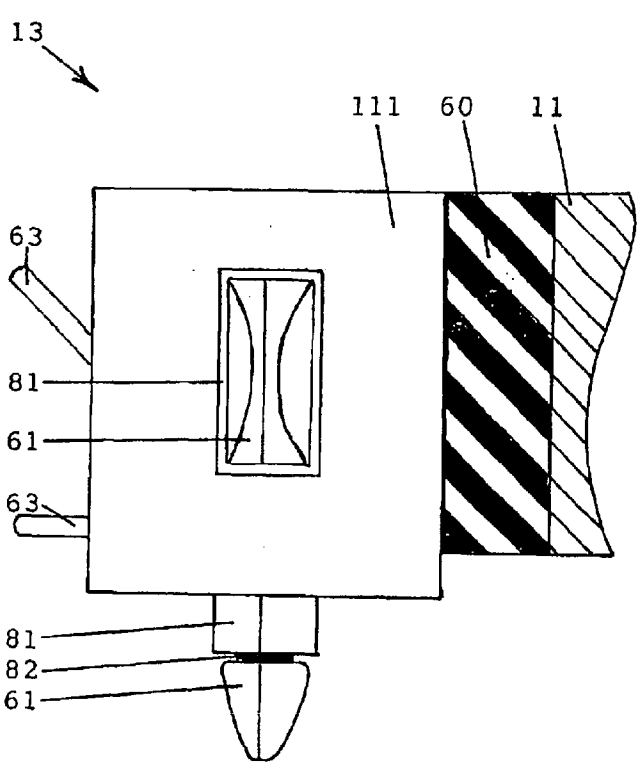
Figure 12A:
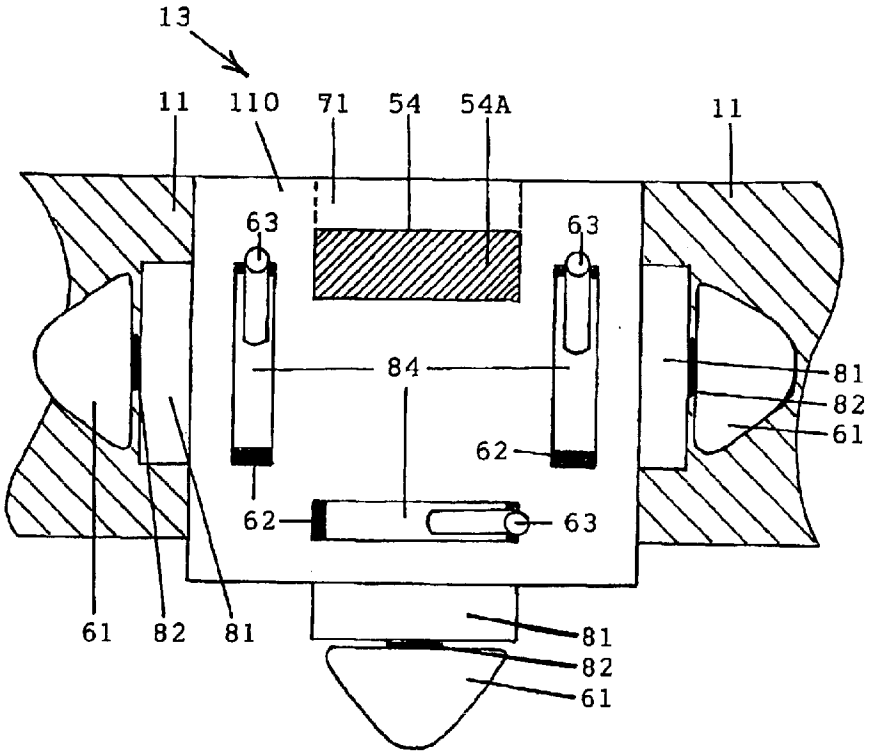
Figure 13B:
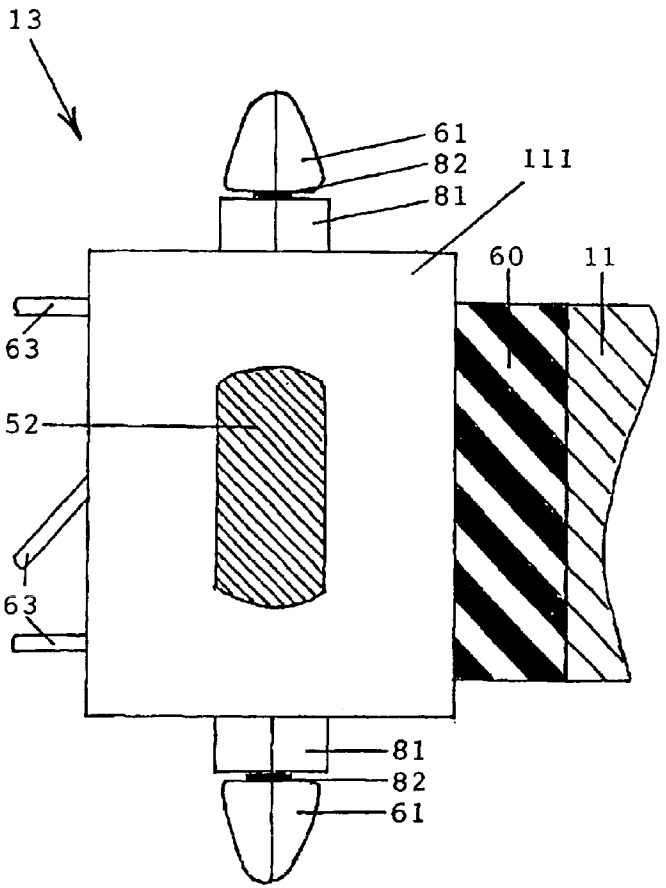
Figure 13A:
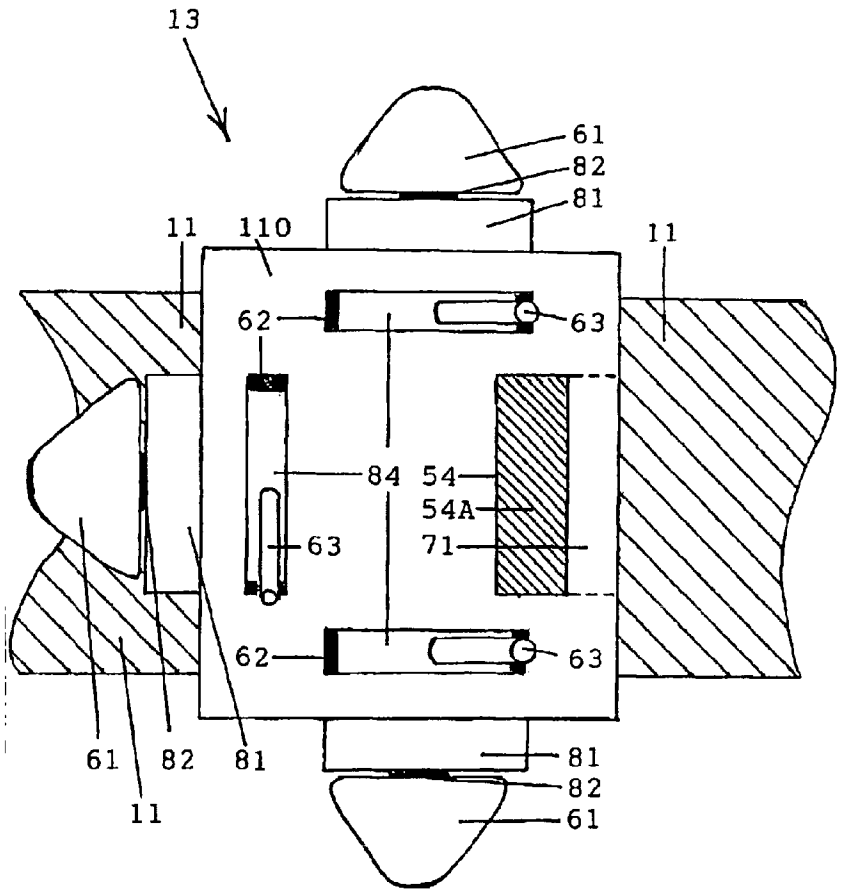
Figure 14:
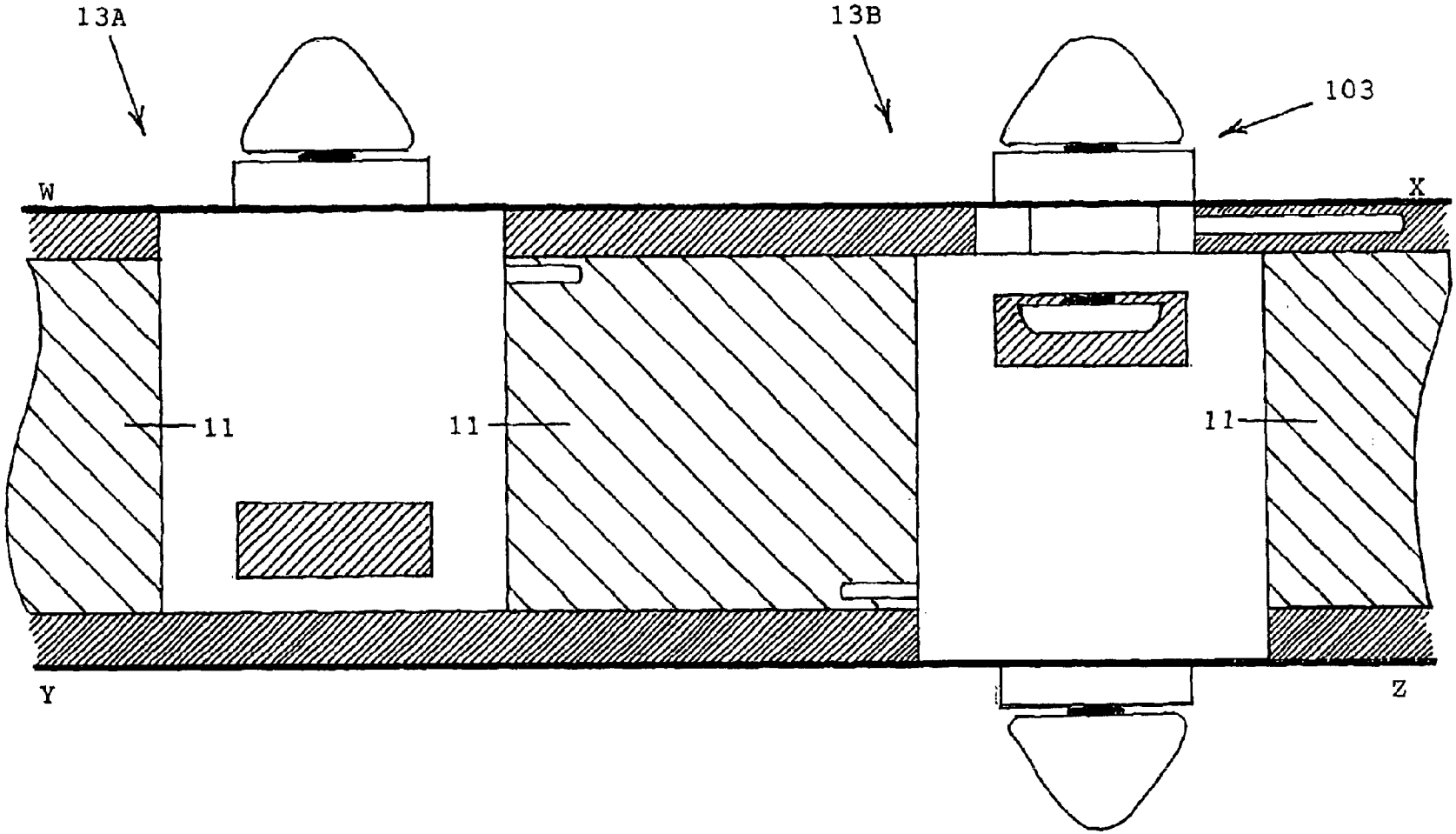

FIG. 3 is a perspective view of the frame of FIG. 1 releasably secured atop a long container by connection of downward-acting surfaces of bi-acting connectors of the linking frame with all corresponding mounting-points at the upper surface of the container. Two shorter length containers are releasably secured atop the frame by connection of all mounting-points at the bottom corners of the shorter containers with the corresponding upward-acting surfaces of bi-acting connectors at the top surface of the frame;

FIG. 4 is a perspective view of the frame of FIG. 1 releasably secured atop a long container by connection of downward-acting surfaces of bi-acting connectors of the linking frame with all corresponding mounting-points at the upper surface of the container. One medium length container is releasably secured atop the frame by connection of all mounting-points at the bottom corners of the medium length container with the corresponding upward-acting surfaces of bi-acting connectors at the top surface of the frame;

FIG. 5A is an upper perspective view of a female bi-acting connector that may be used with the frame of FIG. 1 and that is directly attached outward the outer side surface of a longitudinal beam of said frame. Said bi-acting connector is provided with a female locking-aperture at each of its upper and lower surfaces and an inspection hole in each of its exposed side surfaces that provide visibility into an internal locking-chamber;

FIG. 5B is a lower perspective view of a female bi-acting connector as referred-to and described for FIG. 5A;

FIG. 6 is a lower perspective view of a male bi-acting connector that may be used with the frame of FIG. 1 and that is indirectly attached outward the outer side surface of a longitudinal beam of said frame by means of a lateral connecting beam. Said bi-acting connector is provided with a male locking-cone at each of its upper and lower surfaces, the control-levers for the operation of said locking-cones being conjoined by connecting-rods with corresponding control-levers on male surfaces of a bi-acting connector located diametrically opposite to it, on the other side of the linking frame framework;

FIG. 7A is a side view at right angles to a longitudinal beam of the frame of FIG. 1 showing another embodiment of a female bi-acting connector that may be used with the frame of FIG. 1. Said bi-acting connector is attached to said longitudinal beam and is provided with upward-acting and downward-acting surfaces that are female. Separate inspection holes are provided upon the exposed side surfaces of said bi-acting connector instead of the singular elongate inspection holes as provided upon the female bi-acting connector of FIGS. 5A and 5B. Said inspection holes provide visibility into one combined locking chamber or two separate locking chambers;

FIG. 7B is an upper plan view of the bi-acting connector of FIG. 7A indirectly attached protruding outward a longitudinal beam of the frame of FIG. 1 by means of a lateral connecting beam;

FIG. 7C is a view at an angle parallel to a longitudinal beam of the frame of FIG. 1 showing the bi-acting connector of FIG. 7A;

FIG. 7D is a lower plan view of the bi-acting connector of FIG. 7A;

FIG. 8A is a view at right angles to a longitudinal beam of the frame of FIG. 1 showing the bi-acting connector of FIG. 6 that is attached to said longitudinal beam and that may be used with said frame of FIG. 1, said bi-acting connector being provided with an upward-acting surface and a downward-acting surface each of which is male;

FIG. 8B is a view at an angle parallel to a longitudinal beam of the frame of FIG. 1 showing the bi-acting connector of FIG. 8A indirectly attached protruding outward said longitudinal beam by means of a lateral connecting beam;

FIG. 9A is a view at right angles to a longitudinal beam of the frame of FIG. 1 showing another embodiment of a bi-acting connector that is attached to said longitudinal beam and that may be used with said frame of FIG. 1, said bi-acting connector being provided with an upward-acting surface that is male and a downward-acting surface that is female and that may or otherwise be rotated vertically 180 degrees;

FIG. 9B is a view at an angle parallel to a longitudinal beam of the frame of FIG. 1 showing the bi-acting connector of FIG. 9A attached protruding outward said longitudinal beam by means of a connecting beam;

FIG. 10A is a view at right angles to a longitudinal beam of the frame of FIG. 1 showing a different embodiment of a bi-acting connector that is attached to said longitudinal beam and that may be used with said frame of FIG. 1, said bi-acting connector being provided with an upward-acting surface and a downward-acting surface each of which is male and also being provided with an upward-acting surface and a downward-acting surface each of which is female, said bi-acting connector being capable of being rotated 90 degrees to vertical such that either said pair of male or said pair of female acting surfaces may be used for vertical connection with corresponding mounting-points;

FIG. 10B is a view at an angle parallel to a longitudinal beam of the frame of FIG. 1 showing the bi-acting connector of FIG. 10A attached protruding outward said longitudinal beam by means of a connecting beam;

FIG. 10C is a view at right angles to a longitudinal beam of the frame of FIG. 1 showing the embodiment of a bi-acting connector of FIG. 10A that has been rotated to bring the male surfaces into an inactive position and to bring both female surfaces into an active position such that they may be used for vertical connection with corresponding mounting-points, a male mounting-point being connected to the downward-acting female surface and a portable twist-lock mechanism being connected to the upward-acting female surface of said embodiment;

FIG. 10D is a view at an angle parallel to a longitudinal beam of the frame of FIG. 1 showing the bi-acting connector of FIG. 10A attached protruding outward said longitudinal beam by means of a connecting beam;

FIG. 11A is a view at right angles to a longitudinal beam of the frame of FIG. 1 showing a different embodiment of a bi-acting connector that is attached to said longitudinal beam and that may be used with said frame of FIG. 1, said bi-acting connector being provided with an upward-acting surface that is male and an opposed downward-acting surface that is female and also being provided with opposed upward-acting and downward-acting surfaces each of which is male, said bi-acting connector being capable of being rotated 90 degrees to vertical so that either of said pairs of opposed acting surfaces may be used for vertical connection with corresponding mounting-points, said embodiment of a bi-acting connector being shown supported upon a surface, to which it is attached by a twist-lock mechanism provided upon said surface;

FIG. 11B is a view at an angle parallel to a longitudinal beam of the frame of FIG. 1 showing the bi-acting connector of FIG. 11 indirectly attached protruding outward said longitudinal beam by means of a connecting beam, said bi-acting connector being shown supported upon a surface, to which it is attached by a twist-lock mechanism provided upon said surface;

FIG. 12A is a view at right angles to a longitudinal beam of the frame of FIG. 1 showing the embodiment of a bi-acting connector of FIG. 11A that has been rotated to bring the female acting surface into an upward-acting position and to bring the opposed male acting surface into a downward-acting position such that they may be used for vertical connection with corresponding mounting-points;

FIG. 12B is a view at an angle parallel to a longitudinal beam of the frame of FIG. 1 showing the bi-acting connector of FIG. 12A attached protruding outward said longitudinal beam by means of a connecting beam;

FIG. 13A is a view at right angles to a longitudinal beam of the frame of FIG. 1 showing the embodiment of a bi-acting connector of FIG. 11A that has been rotated to bring the two opposed male acting surfaces into vertically-acting positions such that they may be used for upward and/or downward connection with corresponding mounting-points;

FIG. 13B is a view at an angle parallel to a longitudinal beam of the frame of FIG. 1 showing the bi-acting connector of FIG. 13A attached protruding outward said longitudinal beam by means of a connecting beam;

FIG. 14 is a view at right angles to a longitudinal beam of the frame of FIG. 1 showing two bi-acting connectors referred-to herein as FIG. 9A that are attached to said beam to explain by example the horizontal lines of interface between for example containers and the male and female acting surfaces of bi-acting connectors as may be used with frames of the present invention;

FIG. 1 shows a view of a linking frame generally indicated 10. Said frame 10 comprises two parallel longitudinal beams 11 connected by shorter lateral beams 12. Directly attached protruding outward the outer side surfaces of longitudinal beams 11 are bi-acting connectors 13 that are configured so as to be capable of receiving locking-cones from above and below. Said bi-acting connectors 13 are located at longitudinal distances that correspond with mounting-points of a variety of layouts as provided upon cargo containers.

Figure 2:
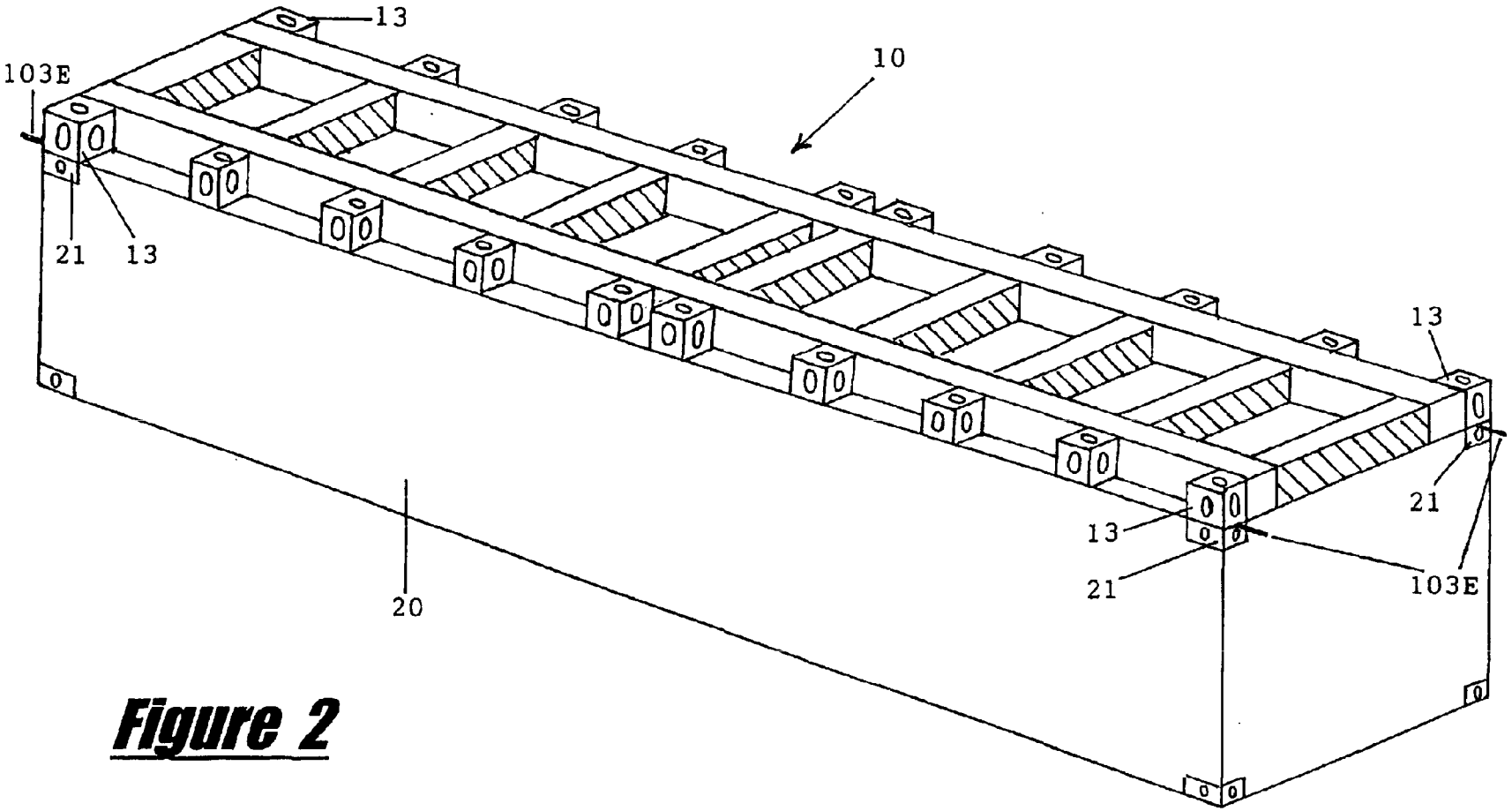
FIG. 2 is a perspective view of the frame of FIG. 1 releasably secured atop a long container by connection of downward-acting surfaces of bi-acting connectors of the linking frame with all corresponding mounting-points at the upper surface of the container.

FIG. 2 shows the frame of FIG. 1 releasably secured atop a long container 20 by way of the downward-acting surfaces of four of the bi-acting connectors 13 on the linking frame 10 connecting with the corresponding mounting-points 21 at all top corners of long container 20. Control-levers 103E of portable twist-lock mechanisms protrude from the mated surfaces between the linking frame 10 and long container 20.

FIG. 3 shows the frame of FIG. 1 releasably secured atop a long container 20 by way of the downward-acting surfaces of four of the bi-acting connectors 13 on the linking frame 10 connecting with the corresponding mounting-points 21 at all top corners of long container 20. A pair of linearly aligned short-length containers 30 are releasably secured to the linking frame 10 by way of the upward-acting surfaces of eight of the bi-acting connectors 13 on the linking frame 10 connecting with the corresponding mounting-points 31 at all bottom corners of the pair of short length containers 30. Control-levers 103E of portable twist-lock mechanisms protrude from the mated surfaces between the linking frame 10 and long container 20 and also from the mated surfaces between said linking frame 10 and the short-length containers 30.

FIG. 4 shows the frame of FIG. 1 releasably secured atop a long container 20 by way of the downward-acting surfaces of four of the bi-acting connectors 13 on the linking frame 10 connecting with the corresponding mounting-points 21 at the top corners of long container 20. One medium-length container 40 is releasably secured to the linking frame 10 by way of the upward-acting surfaces of four of the bi-acting connectors 13 on the linking frame 10 connecting with the corresponding mounting-points 41 at all the bottom corners of medium-length container 40. Control-levers 103E of portable twist-lock mechanisms protrude from the mated surfaces between said linking frame 10 and medium-length container 40.

FIG. 5A shows an upper perspective view of a female bi-acting connector generally indicated 13. The external surface of side 50 of the bi-acting connector 13 is directly attached protruding outward the outer side surface of a longitudinal beam 11 of the frame of FIG. 1. Upper surface 51 of the bi-acting connector 13 contains a female locking aperture 52 of standard dimensions that is able to correspond indirectly with female mounting-points as provided upon the lower surfaces of cargo containers by the use of portable twist-lock mechanisms (not shown). Side surfaces 53 of the bi-acting connector 13 contain inspection holes 54 that provide visibility into internal locking-chamber 54A.

FIG. 5B shows a lower perspective view of the female bi-acting connector of FIG. 5A generally indicated 13. The external surface of side 50 of the bi-acting connector 13 is directly attached protruding outward the outer side surface of a longitudinal beam 11 of the frame of FIG. 1. Side surfaces 53 of the bi-acting connector 13 contain inspection holes 54 that provide visibility into internal locking-chamber 54A. Lower surface 55 of the bi-acting connector 13 contains a female locking aperture 52 of standard dimensions that is able to correspond indirectly with female mounting-points as provided upon the upper surfaces of cargo containers by the use of portable twist-lock mechanisms (not shown).

FIG. 6 shows a lower perspective view of a male bi-acting connector generally indicated 13 indirectly attached protruding outward the outer side surface of a longitudinal beam 11 of the frame of FIG. 1 by means of a lateral beam 60. Also attached to said longitudinal beam 11 is a lateral beam 12 that connects said longitudinal beam to a parallel longitudinal beam 11 (not shown) of the frame of FIG. 1. At the upward-acting surface of the bi-acting connector 13 is a rotatable locking cone 61 that is located so as to be able to correspond with female mounting-points as fitted to the lower surfaces of cargo containers. At the downward-acting surface of the bi-acting connector 13 is a rotatable locking cone 61 that is located so as to be able to correspond with female mounting-points as fitted to the upper surfaces of cargo containers. Protruding from apertures 62 are control-levers 63 that are connected via hinges 64 to connecting-rods 65. Connecting-rods 65 pass through apertures 66 in longitudinal beam 11 to connect with corresponding control-levers on the male acting surfaces of a bi-acting connector (not shown) laterally opposite, on the other side of the linking frame framework.

FIG. 7A shows a side view of a female bi-acting connector generally indicated 13 attached protruding outward longitudinal beam 11 of the frame of FIG. 1 and that is provided with an upward-acting surface and a downward-acting surface each of which is female. Side surface 70 of the bi-acting connector 13 is provided with inspection holes 54 that provide visibility into internal locking-chamber/s 54A. Leading into internal locking-chamber/s 54A by way of a female locking-aperture 52 (not shown) in upper surface 72 (not shown) and lower surface 74 (not shown) are hollow channels 71 through which locking-cones of standard dimensions (not shown) are able to pass, there being sufficient clearance within said locking-chamber/s 54A for said standard locking-cones to rotate and also sufficient horizontal surface area available at the internal end of hollow channels 71 for said locking-cones to be able to grip said surfaces and thereby releasably secure against them.

FIG. 7B shows an upper plan view of the female bi-acting connector of FIG. 7A generally indicated 13 indirectly attached protruding outward a longitudinal beam 11 of the frame of FIG. 1 by way of a lateral beam 60. Upper surface 72 of said bi-acting connector 13 contains a female locking-aperture 52 of standard dimensions.

FIG. 7C shows a view at an angle parallel to a longitudinal beam 11 of the frame of FIG. 1 showing the female bi-acting connector of FIG. 7A generally indicated 13 indirectly attached protruding outward said longitudinal beam 11 by means of a lateral connecting beam 60. Side surface 73 is provided with inspection holes 54 that provide visibility into internal locking-chamber/s 54A. Leading into internal locking-chamber/s 54A by way of a female locking-aperture 52 (not shown) in upper surface 72 (not shown) and lower surface 74 (not shown) are hollow channels 71 through which locking-cones of standard dimensions (not shown) are able to pass.

FIG. 7D shows a lower plan view of the female bi-acting connector of FIG. 7A generally indicated 13 indirectly attached protruding outward a longitudinal beam 11 of the frame of FIG. 1 by means of a lateral connecting beam 60.Lower surface 74 of said bi-acting connector 13 is provided with a female locking-aperture 52 of standard dimensions.

FIG. 8A shows a side view of the male bi-acting connector of FIG. 6 generally indicated 13 attached protruding outward longitudinal beam 11 of the frame of FIG. 1 that is provided with an upward-acting surface and a downward-acting surface each of which is male. Side surface 80 of said bi-acting connector 13 in the embodiment described herein is solid. Protruding from each upper and lower surface of said bi-acting connector 13 is a plinth 81 through which pass spindles 82, each said spindle 82 being attached to a male locking-cone 61. Protruding from apertures 62 (not shown) are control-levers 63.

FIG. 8B shows a view at an angle parallel to a longitudinal beam 11 of the frame of FIG. 1 of the male bi-acting connector of FIG. 6 generally indicated 13 indirectly attached protruding outward said longitudinal beam 11 by means of lateral beam 60. The upper and lower ends of side surface 83 are each provided with an aperture 62 through which protrudes a control lever 63 that is attached to spindle retainer 84.

FIG. 9A shows a side view of a mixed-gender bi-acting connector generally indicated 13 attached to a longitudinal beam 11 of the frame of FIG. 1 that is provided with an acting surface that is male and an acting surface that is female, said bi-acting connector 13 being attached rigidly to said frame or being able to be rotated 180 degrees. Protruding from the upper surface of said bi-acting connector 13 is a plinth 81 through which passes spindle 82, said spindle 82 being attached to a male locking-cone 61. Protruding from aperture 62 (not shown) is a control-lever 63. At the lower end of side surface 90 of said bi-acting connector 13 there is provided an inspection hole 54 that provides visibility into internal locking-chamber 54A. Leading into locking-chamber 54A by way of a female locking-aperture 52 (not shown) is a hollow channel 71 through which a locking cone of standard dimensions (not shown) is able to pass.

FIG. 9B shows a view at an angle parallel to a longitudinal beam 11 of the frame of FIG. 1 of the bi-acting connector of FIG. 9A generally indicated 13 indirectly attached protruding outward said longitudinal beam 11 by means of lateral beam 60. Protruding from the upper surface of said bi-acting connector 13 is a plinth 81 through which passes spindle 82, said spindle 82 being attached to a male locking-cone 61. The upper end of side surface 91 is provided with an aperture 62 through which protrudes a control lever 63 that is attached to spindle retainer 84. The lower end of side surface 91 of said bi-acting connector 13 is provided with an inspection hole 54 that provides visibility into internal locking-chamber 54A. Leading into locking-chamber 54A by way of a female locking-aperture 52 (not shown) is a hollow channel 71 through which a locking cone of standard dimensions (not shown) is able to pass.

FIG. 10A shows a side view of a mixed-gender bi-acting connector generally indicated 13 attached protruding outward a longitudinal beam 11 of the frame of FIG. 1 that is provided with an opposed pair of male acting surfaces and an opposed pair of female acting surfaces, said bi-acting connector 13 being able to be rotated 90 degrees to vertical such that either of said opposed pairs of male or female acting surfaces may be releasably secured with corresponding mounting-points above and/or below. Protruding from the upper and lower surfaces of said bi-acting connector 13 are plinths 81 through which pass spindles 82, each said spindle 82 being attached to a male locking-cone 61. Side surface 100 of said bi-acting connector 13 is provided with apertures 62 through which protrude control-levers 63 that are attached to spindle-retainers 84. Also provided upon side surface 100 of said bi-acting connector 13 are inspection holes 54 that provide visibility into internal locking-chamber/s 54A. Leading into locking-chamber/s 54A by way of female locking-apertures 52 (not shown) are hollow channels 71 through each of which a locking cone of standard dimensions (not shown) is able to pass.

FIG. 10B shows a view at an angle parallel to a longitudinal beam 11 of the frame of FIG. 1 of the bi-acting connector described herein as FIG. 10A generally indicated 13 indirectly attached protruding outward said longitudinal beam 11 by means of lateral beam 60. Protruding from the upper and lower surfaces of said bi-acting connector 13 are plinths 81 through which pass spindles 82, each said spindle 82 being attached to a male locking-cone 61. Side surface 101 of said bi-acting connector 13 is provided with a female locking-aperture 52 of standard dimensions that leads to locking-chamber/s 54A. Protruding outward the outermost side surface of said bi-acting connector 13 are control-levers 63.

FIG. 10C shows a side view of the mixed-gender bi-acting connector of FIG. 10A generally indicated 13 attached protruding outward a longitudinal beam 11 of the frame of FIG. 1. Said bi-acting connector 13 has been rotated 90 degrees to vertical and is releasably secured upon a surface 102 that may for example be a cargo container transport by means of connection with a surface of the lower locking-chamber 54A that may be viewed through inspection hole 54. Locking-cone 102A is connected to spindle 102B, said spindle 102B passing through hollow channel 71 and being connected at its lower end within or upon said surface 102 such as to be capable of horizontal rotation. Side surface 100 of said bi-acting connector 13 is provided with apertures 62, through which protrude control-levers 63 that are attached to spindle-retainers 84. Protruding from the horizontally outermost surfaces of said bi-acting connector 13 are plinths 81 through which pass spindles 82, each said spindle 82 being attached to a male locking-cone 61, the opposed acting surfaces upon which said locking-cones 61 are located being passive in the horizontal configuration described herein. For example only a portable male twist-lock mechanism as known in the art and generally indicated 103 is shown releasably secured with the upper locking-chamber 54A of the upward-acting surface of said bi-acting connector 13 by connection with lower rotating locking-cone 103A that may be viewed through inspection hole 54. Lower locking cone 103A is attached to spindle-end 103B of a spindle that passes through hollow channel 71 into the twist-lock body 103C, protruding from aperture 103D (not shown) within which is control-lever 103E. Protruding upward from twist-lock body 103C is plinth 103F, emerging vertically from which is spindle-end 103G of a spindle that is connected to rotating locking-cone 103H.

FIG. 10D shows a view at an angle parallel to a longitudinal beam 11 of the frame of FIG. 1 of the bi-acting connector described herein as FIG. 10C generally indicated 13 indirectly attached protruding outward said longitudinal beam 11 by means of lateral beam 60 and releasably secured upon a surface 102 that may for example be a trailer. A portable twist-lock mechanism generally indicated 103 is releasably secured to the upward-acting surface of said bi-acting connector 13. Excepting side surface 101 all parts are like FIG. 10C and are given like reference numerals corresponding with the descriptions for FIG. 10C.

FIG. 11A shows a side view of a mixed-gender bi-acting connector generally indicated 13 attached protruding outward a longitudinal beam 11 of the frame of FIG. 1. Said bi-acting connector 13 is releasably secured upon a surface 102 that may for example be a cargo container transport and is provided with an opposed pair of acting surfaces of which one is male and one is female, said pair of acting surfaces being in active positions and thereby able to releasably secure to corresponding mounting-points above and/or below and also provided with an opposed pair of male acting surfaces that are in a passive position, said bi-acting connector 13 being able to be rotated 90 degrees and 180 degrees to vertical such that either of said opposed pairs of acting surfaces may be releasably secured with corresponding mounting-points above and/or below. Excepting side surface 110 all parts are like FIG. 10C and are given like reference numerals corresponding with the descriptions for FIG. 10C.

FIG. 11B shows a view at an angle parallel to a longitudinal beam 11 of the frame of FIG. 1 of the bi-acting connector described herein as FIG. 11A generally indicated 13 indirectly attached protruding outward said longitudinal beam 11 by means of lateral beam 60 and releasably secured upon a surface 102 that may for example be a trailer. Excepting side surface 111 all other parts are like FIG. 10C and are given like reference numerals corresponding with the descriptions for FIG. 10C.

FIG. 12A shows a side view of the mixed-gender bi-acting connector herein described as FIG. 11A generally indicated 13 attached protruding outward a longitudinal beam 11 of the frame of FIG. 1. Said bi-acting connector 13 is rotated 180 degrees to alter the gender of the upper-acting and downward-acting surfaces in relation to mounting-points corresponding with said bi-acting connector 13 from above and/or below. Excepting side surface 110 all other parts are like FIG. 10C and are given like reference numerals corresponding with the descriptions for FIG. 10C.

FIG. 12B shows a view at an angle parallel to a longitudinal beam 11 of the frame of FIG. 1 of the bi-acting connector described herein as FIG. 12A generally indicated 13 indirectly attached protruding outward said longitudinal beam 11 by means of lateral beam 60. Excepting side surface 111 all parts are like FIG. 10C and are given like reference numerals corresponding with the descriptions for FIG. 10C.

FIG. 13A shows a side view of the mixed-gender bi-acting connector herein described as FIG. 11A generally indicated 13 attached protruding outward a longitudinal beam 11 of the frame of FIG. 1. Said bi-acting connector 13 has been rotated 90 degrees to alter the gender of the upper-acting and downward-acting surfaces in relation to mounting-points that may correspond with said bi-acting connector 13 from above and/or below. Excepting side surface 110 all parts are like FIG. 10C and are given like reference numerals corresponding with the descriptions for FIG. 10C.

FIG. 13B shows a view at an angle parallel to a longitudinal beam 11 of the frame of FIG. 1 of the bi-acting connector described herein as FIG. 13A generally indicated 13 indirectly attached protruding outward said longitudinal beam 11 by means of lateral beam 60. Excepting side surface 111 all parts are like FIG. 10C and are given like reference numerals corresponding with the descriptions for FIG. 10C.

FIG. 14 shows a side view of two of the bi-acting connectors referred-to herein as FIG. 9A attached outward the outer side surface of longitudinal beam 11 of the frame of FIG. 1 and being generally indicated as 13A and 13B. Lines W to X and Y to Z represent the lines of interface between a frame of the present invention and any surface/s releasably secured to said frame by means of corresponding mounting-points. A standard portable twist-lock mechanism generally indicated 103 is secured within the female upward-acting surface of bi-acting connector 13B. The different embodiments of and mobility of bi-acting connectors as described for example herein enable male and female acting surfaces of said bi-acting connectors to be inter-mixed upon a frame of the present invention whereby the releasable securing of transport equipment to said frame by way of mounting-points is not impeded by male locking-cones and plinths protruding into the surfaces of containers whereat said containers are not provided with mounting-points. The relative vertical geometry of male and female acting surfaces of bi-acting connectors as referred-to herein also ensures that, whenever said surfaces are inter-mixed horizontally upon a frame of the present invention, the seating of standard portable twist-lock mechanisms within said female acting surfaces will provide the same lines of interface as provided by said male acting surfaces.

What is claimed is:

1. A transport linking frame for the literally symmetrical vertical linking of one or a linearly aligned pair of cargo containers having a first length and having a first layout of mounting-points to one or a linearly aligned pair of cargo containers having a second length and having a second layout of mounting-points, the transport linking frame comprising two parallel longitudinal beams (11);

a plurality of literal beams (12) shorter that the longitudinal beams (11) and connecting the longitudinal beams (11);

a plurality of connectors (13) for connecting to containers;

characterised in that the connectors are bi-acting connectors (13) protruding laterally outwards from the longitudinal beams (11), the bi-acting connectors (13) being spaced longitudinally along the frame to correspond with mounting points of a plurality of lay-outs on cargo containers, and the bi-acting connectors (13) including at least two opposed acting surfaces (51,55) arranged to mate with container mounting points of containers above and below the transport linking frame, said acting surfaces (51,55) being either female acting surface containing locking apertures (52) or alternatively being male acting surfaces containing internal channels retaining a rotatable spindle or spindles having locking-cones (61) at one or each end, each locking-cone (61) having a control-lever (63) enabling it to be rotated.

2. A transport linking frame an claimed in claim 1, wherein the plurality of bi-acting connectors (13) are attached protruding outwards from the longitudinal beams (11) to enable them to be removed from said framework and then to be attached to alternative positions along a lateral or longitudinal axis of said linking frame.

3. A transport linking frame as claimed in claim 1, wherein the plurality of bi-acting connectors (13) are attached protruding outwards from the longitudinal connectors (13) to be slid to alternative positions along a lateral and/or longitudinal axis of said linking frame.

4. A transport linking frame as claimed in claim 1, wherein the plurality of bi-acting connectors (13) are attached protruding outwards from the longitudinal beams (11) to enable them to be unlocked from said linking frame, thereupon to be rotated around a horizontal axis and then to be re-locked to mid linking frame.

5. A transport linking frame ma claimed in claim 1, wherein each locking-cone (61) of a male acting-surface of a bi-acting connector (13) attached to said frame, when not required to connect with the mounting-point of a cargo container, is capable of retention within said bi-acting connector (13) and, when required to operate, is capable of being raised above said outer surface for the purpose of releasably securing to a mounting-point of cargo container.

6. A transport linking frame as chimed in claim 1, said plurality of connectors (13) further including a plurality of male bi-acting connectors (13) attached to said linking frame, wherein the control-lever (63) the for the operation of the rotatable locking-cone (61) of the male bi-acting connectors are joined by means of a hinged (64) connecting-rod system (65) to the control-lever (63) of one or more other rotatable locking-cones (61) of other male bi-acting connectors (13) affixed to said linking frame at other horizontally-opposed positions, thereby enabling mid control-lever (63) to be operated in unison, said connecting-rod system being located between the levels of the upper and lower acting surfaces of the bi-acting connectors (13) affixed to said linking frame.

7. A transport linking frame as claimed in claim 1, wherein both of the outwardly-opposed acting-surfaces (51, 55) of bi-acting connectors (13) attached to said linking frame are female and comprise uni-acting cargo container corner castings that are configured so as to be capable of receiving locking cones from above and that are conjoined with uni-acting cargo container corner castings that are configured so as to be capable of receiving locking cones from below.

8. A transport linking frame as claimed in claim 1, wherein there is provided upon the exterior of any of the frame's vertical surfaces, or emerging from exit apertures within any of said surfaces, extending means to enable said linking frame to be releasably secured laterally with one or more other linking frames or one or more cargo containers or a means of transport to which said linking frame is not otherwise releasably secured, said extending means being located between the levels of the upper and lower acting-surfaces of the bi-acting connectors affixed to said linking frame.

9. A transport linking frame as claimed in claim 1, wherein there is provided upon the upper horizontal surface of said linking frame a floor for the support of general cargo, the upper surface of said floor being no higher than a level flush with the uppermost upward-acting surfaces (51) of bi-acting connectors affixed to said linking frame, the outer edges of said floor being shaped so as not to impede the mobility or operation of said bi-acting connectors (13).

10. A transport linking frame as claimed in claim 1, wherein there is provided attachment points or ratchets for use in the securement of cargo loaded to the upper surface of said linking frame.

11. A transport linking frame as claimed in claim 1, wherein them is provided removable cargo retention means that are able to be releasably secured to the upper surface of said linking frame by way of mounting-points at their lower ends or edges that are able to secure to the upward-acting surfaces (51) of bi-acting connectors (13) affixed to said linking flame.

12. A method using a linking frame of the present invention to vertically stack a first tier of container's upon a second tier of container/s and releasably secure said containers indirectly to form a single unit for transport or lifting purposes, said containers having mutually different lengths or mounting-point layouts, wherein one or more of said containers within one or both of said tiers is provided with one or more pairs of mounting-point between its longitudinally outermost corners and to provide a space between the mated surfaces of said tiers of containers in which to safely operate the control-levers of mated portable twist-locks and to clearly observe whether said control-levers are locked or unlocked, which said method comprises: lifting a container or pair of linearly aligned containers of a first tier onto a frame of the present invention; releasably securing said container/s to the upper surface of said frame by way of all upward-acting surfaces of bi-acting connectors provided upon said frame being connected with all mutually corresponding mounting-points of said container/s; lifting said combination of container/s and frame onto a second tier of a container or pair of linearly aligned container; releasably securing the lower surface of said frame to the upper surface/s of said second tier of container/s by way of all downward-acting surfaces of bi-acting connectors provided upon said frame being connected with all mutually corresponding mounting-points of said second tier of container/s, the control-levers of said bi-acting connectors being clearly visible and safely operable through voids provided adjacent to said bi-acting connectors of a frame of the present invention.

* * * * *